US005749040A

United States Patent [19]

Muramatsu

[11] Patent Number: 5,749,040

[45] Date of Patent: May 5, 1998

[54] IMAGE FORMING APPARATUS CAPABLE OF CORRECTING CURL OF SHEET

[75] Inventor: Masanori Muramatsu, Yokohama, Japan

[73] Assignee: Canon Kabushiki Kaisha, Tokyo, Japan

[21] Appl. No.: 680,696

[22] Filed: Jul. 18, 1996

[30] Foreign Application Priority Data

Jul. 20, 1995 [JP] Japan ..... 7-184295
Aug. 4, 1995 [JP] Japan ..... 7-199798

[51] Int. Cl.[6] ..... G03G 15/00; B41J 2/00

[52] U.S. Cl. ..... 399/406; 399/45; 399/49; 399/389; 399/410

[58] Field of Search ..... 399/406, 14, 45, 399/49, 376, 389, 407, 410; 271/161, 188, 209; 162/271, 197; 493/459

[56] References Cited

U.S. PATENT DOCUMENTS 4,977,432 12/1990 Coombs et al. ..... 399/406 X
5,084,731 1/1992 Baruch ..... 399/406
5,132,736 7/1992 Muramatsu et al. ..... 399/45
5,187,527 2/1993 Forlani et al. ..... 399/406
5,414,503 5/1995 Siegel et al. ..... 399/406
5,515,152 5/1996 Kuo ..... 399/406
5,542,655 8/1996 Murakami ..... 399/410 X

FOREIGN PATENT DOCUMENTS 5-27608 2/1993 Japan .
6-144679 5/1994 Japan .
6-258906 9/1994 Japan .
7-81804 3/1995 Japan .

*Primary Examiner*—Arthur T. Grimley
*Assistant Examiner*—Sophia S. Chen
*Attorney, Agent, or Firm*—Fitzpatrick Cella, Harper & Scinto

[57] ABSTRACT

There is provided an image forming apparatus in which an amount of toner which is fixed onto a paper serving as a recording material is detected, and on the basis of a detection result and an operating mode of a sorter for sorting the papers, a penetration amount of a metal lower roller for an elastic upper roller of a curl correcting section is changed, thereby adjusting a curl correction amount of the paper between those rollers.

12 Claims, 22 Drawing Sheets

OPTICAL MOTOR DRIVER
RDF CONTROLLER
OPERATION UNIT
ROM
RAM
I/O
READER CONTROLLER
IMAGE PROCESSING UNIT
LASER DRIVER
V3
PRINTER CONTROLLER
I/O
D/A
A/D
RAM
ROM
CURL MOTOR DRIVER
SORTER CONTROLLER
TO FIG. 2B
700
701
702
703
704
705
706
707
708
110
203
750
751
752
753
754
763

CORNER BINDING

DOUBLE BINDING

SINGLE BINDING

FIG. 20A

STOP OPERATION DUE TO POOR
REGISTRATION
REMOVE SHEET OF SORTER

FIG. 20B

STOP OPERATION DUE TO POOR
REGISTRATION

IMAGE FORMING APPARATUS CAPABLE OF CORRECTING CURL OF SHEET

BACKGROUND OF THE INVENTION

1. Field of the Invention

The invention relates to an image forming apparatus which can correct a curl of a sheet.

2. Related Background Art

For example, in an image forming apparatus using an electrophotographic system, generally, there is used a method whereby a toner image formed on a photosensitive drum is transferred to a paper and the toner is fixed onto the paper as a recording material by using a thermal roller. There are also paper post-processing apparatuses such as a sorter and the like that are connected to such an image forming apparatus, thereby executing post-processes such as sorting, stapling, and the like of papers. When using such post-processing apparatuses, particularly, since a curl state of the paper exerts an influence on stacking performance and a registration performance of the papers, an apparatus using the post-processing apparatuses in combination with a curl correcting apparatus has also been proposed.

Although a curl correction control of the proposed apparatus has a construction such that a correction amount of a curl can be switched in accordance with only the kind of paper such as thickness, size, material, or the like of the paper, no consideration is made with respect to a deposition amount of the toner. There is consequently a case such that a control of a desirable curl correction according to the contents (dense, light) of an image cannot be accomplished.

Even if curl correction control is executed, a defective precision of a stapling position or a defective staple becomes a factor of a poor registration occurs in dependence on a combination of the deposition amount (fixing amount) of the toner and the paper size. Particularly, such defects occur due to the relation between the growing direction of the curl and the spacing direction of the paper. Such a defect occurs when the curl correctable direction and the curl growing direction by the toner differ in dependence on a general curl correcting mechanism which can correct the curl in only the paper conveying direction.

When a curl which cannot be corrected by the curl correcting apparatus occurs in a paper, there is a case where the paper in which the correction of the curl is insufficient is sent to the post-processing apparatus such as a sorter or the like. For example, in an image forming apparatus having a general curl correcting apparatus which can correct only a positive curl (convex downward) of the paper, when images are formed on both of the front and back sides of a paper having a possibility of the occurrence of a reverse curl (convex upward), there is a fear such that the paper in a state in which the reverse curl is not corrected is conveyed to the sorter and a poor registration of the paper and a defective precision of the stapling position and a defective staple in association with the poor registration occur.

SUMMARY OF THE INVENTION

It is an object of the invention to provide an image forming apparatus which can solve the above problems.

According to the invention, the above object is accomplished by an image forming apparatus comprising: image forming means for forming an image onto a sheet; curl correcting means which corrects a curl of the sheet and whose correction amount can be adjusted; detecting means for detecting a processing amount of the image forming means which becomes a factor of the occurrence of the curl of the sheet; and control means for controlling the correction amount of the curl by the curl correcting means on the basis of a detection result of the detecting means.

The above and other objects and features of the present invention will become apparent from the following detailed description and the appended claims with reference to the accompanying drawings.

BRIEF DESCRIPTION OF THE DRAWINGS

FIGS. 20A and 20B are explanatory diagrams of display examples when displaying a message in the steps in FIGS. 18 and 19.

DETAILED DESCRIPTION OF THE PREFERRED EMBODIMENTS

Embodiments of the invention will now be described in detail hereinbelow with reference to the drawings.

[First embodiment]

Figure 1:
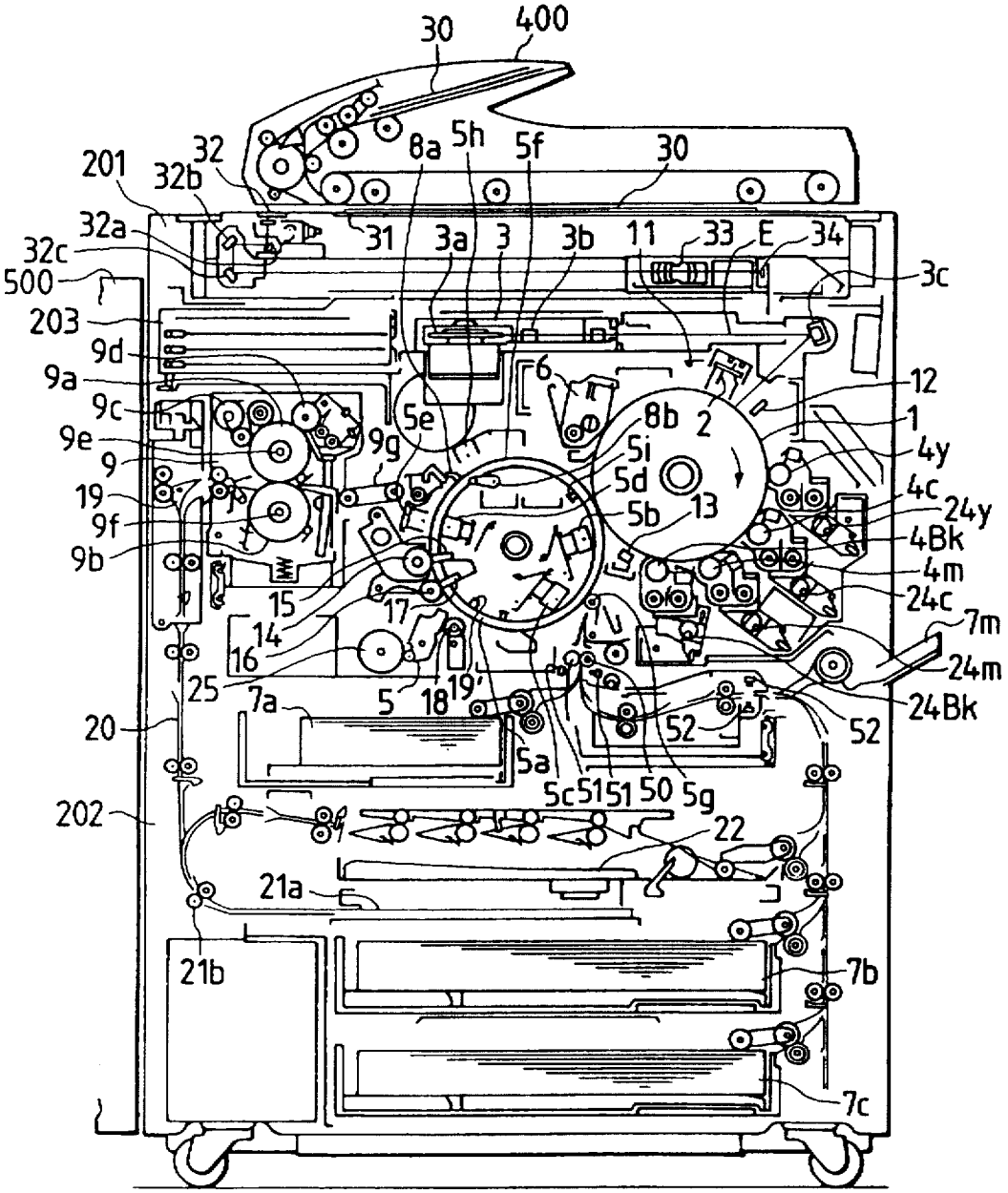
FIG. 1 is a schematic cross sectional view of a color image forming apparatus of an embodiment of the invention.

FIG. 1 is a schematic cross sectional view showing a color image forming apparatus according to the first embodiment of the invention.

In the embodiment, a digital color image reader unit 201 (hereinafter, abbreviated to "reader unit") is provided in the upper portion, a digital color image printer unit 202 (hereinafter, abbreviated to "printer unit") is provided in the lower portion, and an image processing unit 203 is provided between the reader unit 201 and the printer unit 202.

In the reader unit 201, by putting an original 30 onto an original supporting glass plate 31 and exposing and scanning the original by an exposure lamp 32, a reflected light image from the original 30 is converged onto a full-color sensor 34 formed integratedly with RGB 3-color separation filters by a lens 33, thereby obtaining a color separation image analog signal. The color separation image analog signal is converted into a digital signal by an amplifying circuit (not shown) and is processed by the image processing unit 203. After that, the processed signal is sent to the printer unit 202.

In the printer unit 202, a photosensitive drum 1 as an image holding member is supported so as to be rotatably in the direction shown by an arrow. A pre-exposure lamp 11, a corona charging unit 2, a laser exposure optical system 3, an electric potential sensor 12, a developing device (developing units 4*y*, 4*c*, 4*m*, 4B*k*), a sensor 13 for detecting a light amount on the drum, a transfer device 5, and a cleaning unit 6 are arranged around the photosensitive drum 1.

In the laser exposure optical system 3, the image signal from the reader unit 201 is converted into a light signal by a laser output unit (not shown). A converted laser beam is reflected by a polygon mirror 3*a* and passes through a lens 3*b* and a mirror 3*c* and is projected onto the surface of the photosensitive drum 1.

When an image is formed by the printer unit 202, the photosensitive drum 1 is rotated in the direction shown by the arrow, the photosensitive drum 1 after the charges on the drum surface was discharged by the pre-exposure lamp 11 is uniformly charged by the charging unit 2, and a light image E is irradiated every separated color, thereby forming a latent image.

Subsequently, a predetermined developing unit is made operative and the latent image on the photosensitive drum 1 is developed, thereby forming a toner image mainly composed of a resin as a substrate onto the photosensitive drum 1. The developing unit is alternatively allowed to approach the photosensitive drum 1 in accordance with each separation color by the operations of eccentricity cams 24*y*, 24*c*, 24*m*, and 24B*k*.

The toner images developed on the photosensitive drum 1 are transferred to a recording material supplied from recording material cassettes 7*a*, 7*b*, and 7*c* and an intermediate tray 22 or a recording material tray 7*m* through the conveying system and the transfer device 5 to the position which faces the photosensitive drum 1. The transfer device 5 in the embodiment has: a transfer drum 5*a* serving as recording material holding means; a transfer charging unit 5*b*; an adsorbing roller 5*g* which faces an adsorption charging unit 5*c* to electrostatically adsorb the recording material; an inside charging unit 5*d*; and an outside charging unit 5*e*. A recording material holding sheet 5*f* made of a dielectric material is cylindrically integratedly spread in a peripheral surface opening region of the transfer drum 5*a* which is axially supported so as to be rotated. As a recording material holding sheet 5*f*, a dielectric material sheet such as a polycarbonate film or the like is used (hereinafter, referred to as a "transfer sheet 5*f*").

In the embodiment, since the electrostatic adsorption is used as recording material holding means, in case of a recording material (250 mm) of a length that is ½ or less of the whole circumference of the transfer sheet 5*f*, images can be simultaneously formed to two recording materials. A case of simultaneously forming images to two recording papers is hereinafter called a "2-image forming control". A case of forming an image by electrostatically adsorbing one recording material to the transfer sheet 5*f* is called a "1-image forming control".

While the drum-shaped transfer device, namely, transfer drum 5*a* is rotated, the toner image on the photosensitive drum 1 is transferred onto the recording material held on the transfer sheet 5*f* by the transfer charging unit 5*b*. In this manner, a desired number of color images are transferred onto the recording material that is adsorbed to the transfer sheet 5*f* and is conveyed, so that a full-color image is formed. When a full-color image is formed, the recording material after completion of the transfer of the toner images of four colors is separated from the transfer sheet 5*f* from the transfer drum 5*a* by the operations of a separating claw 8*a*, a separation pushing-up roller 8*b*, and a separation charging unit 5*h*. The separated recording material is ejected to a paper ejection curl correcting section 500, which will be explained hereinlater, through a thermal roller fixing unit 9. A curl of the recording material is corrected by the curl correcting section 500 serving as curl correcting means. After that, the recording material is sent to a paper ejection post-processing section 600 shown in FIG. 7 and is subjected to a desired post-process such as sorting, stapling, or the like. The curl correcting section 500 and paper ejection post-processing section 600 will be described hereinlater.

On the other hand, the residual toners on the surface of photosensitive drum 1 after completion of the transfer are cleaned by the cleaning unit 6. The photosensitive drum 1 is subsequently again subjected to an image forming step.

When images are formed on both sides of the recording material, after the recording material on which an image had been formed on one side was ejected from the fixing unit 9, a conveying path switching guide 19' is soon driven, thereby once guiding the recording material to a reversing path 21*a* through a conveying vertical path 20. After that, by reversely rotating a reversing roller 21*b*, the recording material is fed back in the direction opposite to the feeding direction while setting a rear edge of the recording material at the time of the conveyance to a front edge and is enclosed into the intermediate tray 22. After that, an image is again formed on another side of the recording material by the image forming step mentioned above. When the images are formed on both of the front and back sides of the recording material as mentioned above, the first side of the recording material on which the image is first formed is called a "both-side first side" and the second side on which the image is subsequently formed is called a "both-side second side".

In order to prevent scattering and deposition of the powder on the recording material holding sheet 5*f* of the transfer drum 5a, a deposition of an oil, which will be explained hereinlater, on the recording material, or the like, a cleaning is performed by using a fur brush 14 and a fur backup brush 15 which face through the recording material holding sheet 5f, an oil cleaning roller 16 and an oil cleaning backup brush 17 which face through the recording material holding sheet 5f, and a grinding roller 18 and a grinding roller backup brush 19 which face through the recording material holding sheet 5f. Such a cleaning is executed before or after the image formation. The cleaning is executed each time a jam (paper jam) occurs.

In the embodiment, by making an eccentric cam 25 operative at a desired timing and making a cam follower 5i which is integrated with the transfer drum 5a operative, a gap between the recording material holding sheet 5f and the photosensitive drum 1 can be arbitrarily set. For example, in a standby state or when a power source is OFF, an interval between the transfer drum 5a and the photosensitive drum 1 is increased.

A toner density control in the developing device 4 will now be described. The toner in each of the magenta developing unit 4m, cyan developing unit 4c, and yellow developing unit 4y is reflected for a near infrared ray of a wavelength of about 960 nm. Therefore, by using such characteristics, when developing, the reflected light is detected by a detecting sensor 780 of density of a developing material (see FIGS. 2A and 2B) arranged in each developing unit and is converted into a toner density signal by an A/D converter 752 (see FIGS. 2A and 2B). The toner corresponding to the toner density signal is supplied to the developing unit from a hopper (not shown).

On the other hand, since the black toner absorbs the near infrared ray of the wavelength of about 960 nm, the toner density is not detected in the black developing unit 4Bk. The near infrared ray of the wavelength of about 960 nm is irradiated to the black toner image developed on the photosensitive drum 1. The density of the developed black toner is detected from a ratio between the reflected component on the surface of the photosensitive drum 1 and the absorbed component by the black toner. The toner density in the developing unit is calculated on the basis of them.

The sensor 13 for detecting the light amount on the drum is arranged between the black developing unit 4Bk and the transfer charging unit 5b and can detect the black toner image developed by the black developing unit 4Bk before it is transferred. The black toner image can be detected in a state in which a toner density fluctuation by the transferring operation doesn't exist.

The thermal roller fixing unit 9 will now be described in detail hereinbelow. The thermal roller fixing unit 9 has a fixing upper roller 9a, a fixing lower roller 9b, a fixing web 9c, and a fixing oil coating roller 9d.

The thermal roller fixing unit 9 melts the toner on the recording material by thermal energies of the fixing rollers 9a and 9b and fixes the melted toner to the recording material by a pressure between the fixing rollers 9a and 9b. The surfaces of the fixing upper roller 9a and fixing lower roller 9b are controlled so as to independently have optimum surface temperatures by a fixing upper heater 9e and a fixing lower heater 9f which are built in almost the center portion and by a fixing upper thermistor 781 and a fixing lower thermistor 782 for detecting temperatures of the roller surfaces, respectively.

The fixing web 9c is come into contact with the fixing upper roller 9a as necessary in order to eliminate a fouling on the fixing upper roller 9a or the toner which was offset. In this instance, a new surface of the fixing web 9c is come into contact with the fixing upper roller 9a by a winding apparatus built in the fixing web 9c and the cleaning performance can be also improved. The fixing oil coating roller 9d for supplying a silicon oil to the cleaned surface of the fixing upper roller 9a is prepared. The silicon oil is coated onto the fixing upper roller 9a as necessary so that the toner on the recording material is not deposited onto the fixing upper roller 9a.

The thermal roller fixing unit 9 drives the fixing rollers 9a and 9b and a recording material conveying unit 9g by a fixing drive motor (not shown in FIG. 1). The fixing drive motor is driven by a fixing drive motor driver 761 (see FIGS. 2A and 2B). In the embodiment, in order to eliminate a difference of fixing performances due to the kinds of recording materials, fixing speeds corresponding to the four kinds of recording materials can be realized.

Now, assuming that a peripheral speed when an image is practically formed on the photosensitive drum 1 is set to VP (hereinafter, referred to as a "processing speed"), a normal paper fixing speed VFN=VP, a fixing speed VFD for the both-side second side is smaller than VFN, a fixing speed VFT for a thick paper is smaller than VFD, and a fixing speed VFO for an OHP is smaller than VFT. Therefore, there is the relation of VP=VFN>VFD>VFT>VFO. The fixing drive motor driver 761 (see FIGS. 2A and 2B) is constructed so that the above four kinds of fixing speeds can be realized. A conveying speed of the recording material conveying unit 9g is set so as to be equal to the peripheral speed of the fixing rollers 9a and 9b. The fixing speed VFD for the both-side second side is used for the both-side second side for fixing the toners of two or more colors. Even in the both-side second side, the fixing speed VFD is not used in a single color mode in which the toner of one color is fixed. In this case, the fixing operation is executed at the normal paper fixing speed VFN.

The curl correcting section 500 as curl correcting means and the paper ejection post-processing section 600 as processing means will now be described. Those units construct a post-processing apparatus of the recording material for processing a paper as a recording material on which an image has been formed.

Figure 7:
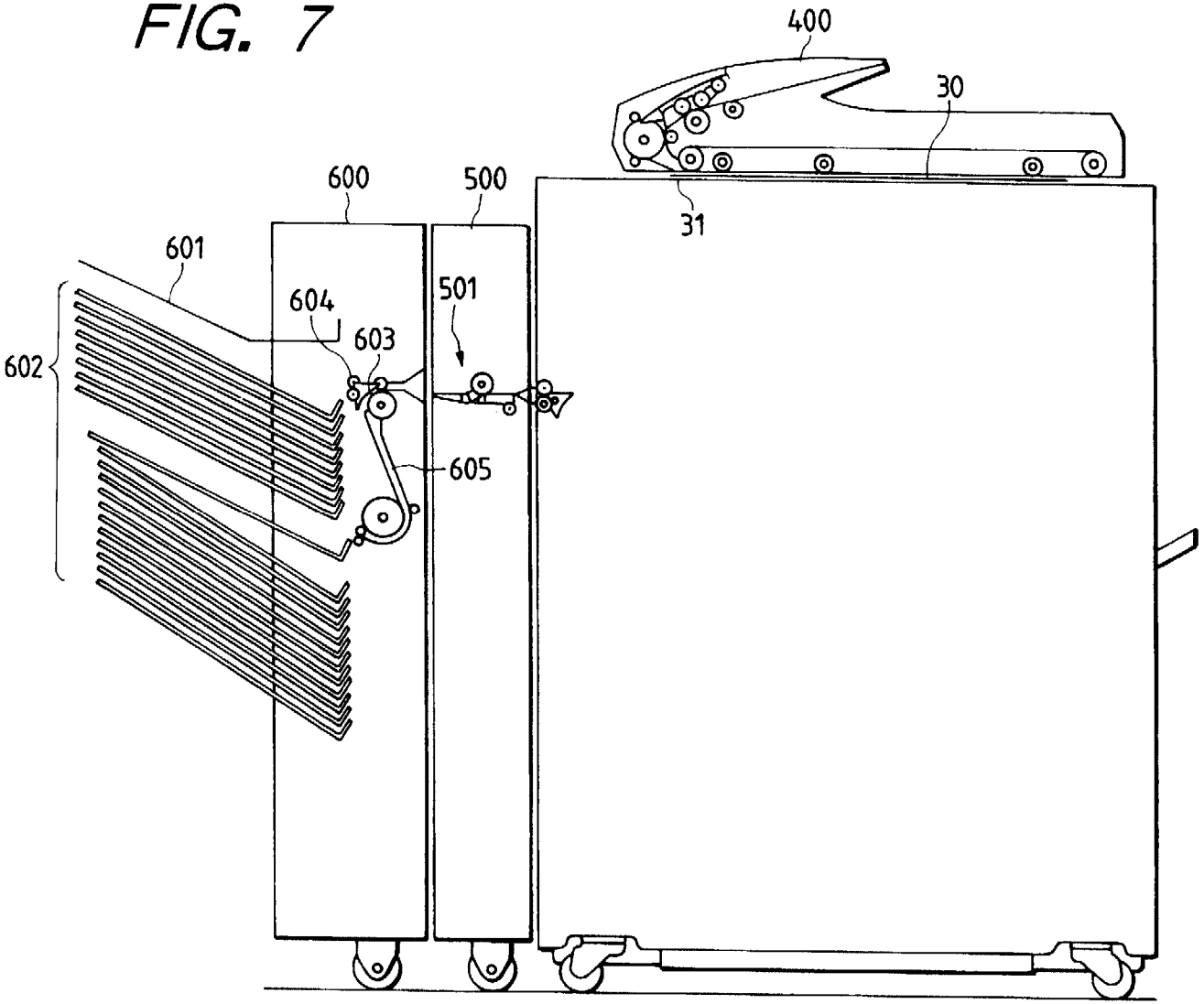
FIG. 7 is a schematic cross sectional view of a curl correcting section and a paper ejection post-processing unit which are connected to the color image forming apparatus in FIG. 1.
Figure 8:
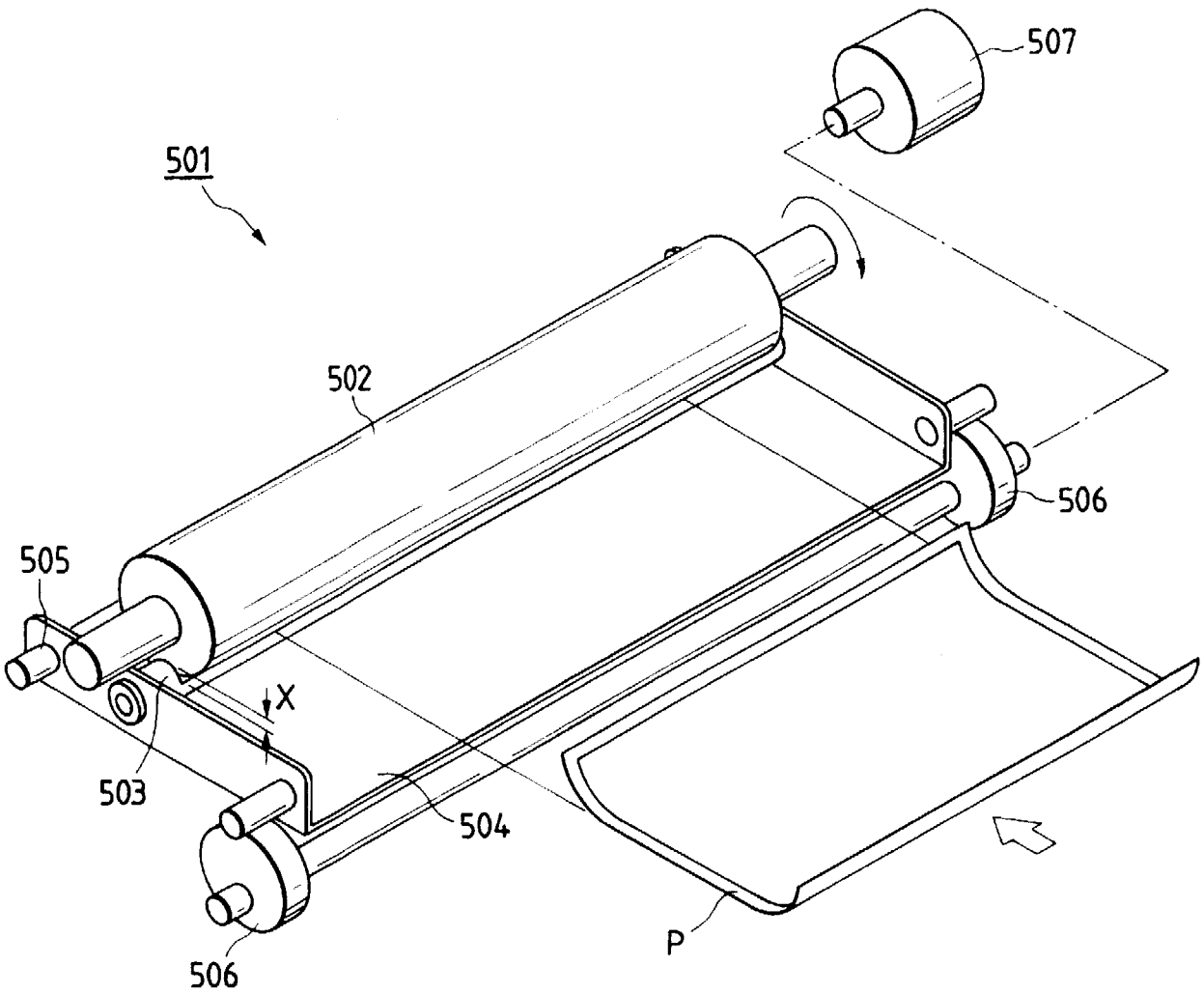
FIG. 8 is a perspective view of a main section of the curl correcting section in FIG. 7.

When the toner image formed by the electrophotographic system is fixed onto the paper, it is known that the paper as a recording material is curled. It is a well-known fact that such a curl exerts an adverse influence on a registration quality when the paper ejection post-process is executed. In the invention, therefore, the curl is corrected by the curl correcting section 500 so as not to exert an adverse influence on the paper ejection post-processing section 600 and, after that, the post-process is executed to the paper. (With respect to the curl correcting section 500) FIG. 8 shows a main section of the curl correcting section 500 shown in FIGS. 1 and 7. In FIG. 8, a curling section 501 is constructed by a soft large diameter upper roller 502 made of an elastic material such as a silicon sponge or the like and a hard small diameter lower roller 503 made of metal. By pressing the metal lower roller 503 to the elastic upper roller 502, a nip portion in an upward convex shape along the outer diameter of the metal lower roller 503 is formed. A positive curl (curl in a downward convex shape) of a paper P which passes through the nip portion is corrected.

A curl correcting ability of the curl correcting section 500 can be adjusted by changing a penetration amount X of the metal lower roller 503 for the elastic upper roller 502. The penetration amount X is changed by swinging a pressurizing arm 504 which supports the metal lower roller 503 by a rotation of an eccentric cam 506 around a supporting axis 505 as a rotational center. The eccentric cam 506 is rotated by driving an eccentric cam motor 507 comprising a stepping motor or the like.

(With respect to the paper ejection post-processing section 600)

The paper ejection post-processing section 600 will now be described (hereinafter, the section 600 is abbreviated to "sorter section"). The sorter section 600 is mainly constructed by two portions as shown in FIG. 7. One of them is a non-sort bin 601 and is used to eject the papers which don't need the sorting operation. The other is a sort bin 602. In the sorting operation, by using the sort bin 602 having 20 bins, the papers are sequentially ejected to each sort bin 602, so that the sorted bundles of papers can be obtained. Reference numeral 603 denotes a sort flapper for switching an ejection output destination for the non-sort bin 601 and sort bin 602. The paper is guided to either one of a non-sort path 604 and a sort path 605 by the flapper 603 and is ejected to the non-sort bin 601 or sort bin 602. As compared with the sort bin 602, the non-sort bin 601 has a construction such that a large quantity of papers can be ejected to the bin.

Figure 9:
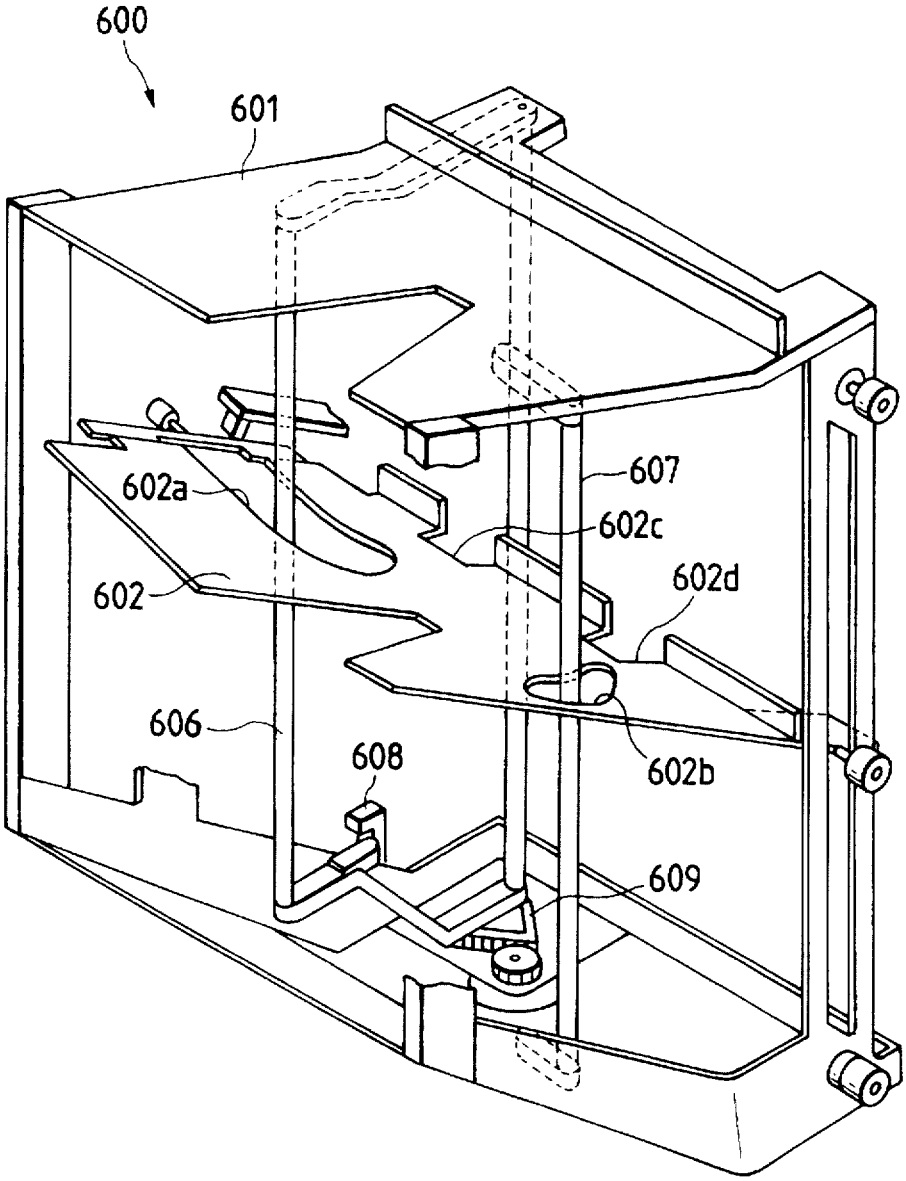
FIG. 9 is a perspective view of a main section of a sorter in FIG. 7.

A registration operation and a stapling operation by the sorter section 600 will now be briefly explained with reference to FIG. 9. FIG. 9 is a perspective view of the sorter 600. For simplicity of explanation, only one bin of the sort bin 602 having 20 bins is shown in the diagram. The papers stacked in the sort bin 602 are subjected to the registration operation by a registration rod 606 and a registration auxiliary rod 607. The registration operation is performed by a method whereby the registration rod 606 hits the side edges of the papers and the papers are sandwiched by the registration rod 606 and the registration auxiliary rod 607. Since the registration operation differs depending on the paper size, it is executed while controlling the operating position of the registration rod 606 by a registration sensor 608 and a registration motor 609 in accordance with the paper size. For this purpose, notches 602*a* and 602*b* are formed in the sort bin 602, thereby allowing a movement of the rods 606 and 607 within a predetermined range. Notches 602*c* and 602*d* for stapling are formed in the sort bin 602 and the papers can be stapled by a stapling unit (not shown).

Figure 10A:
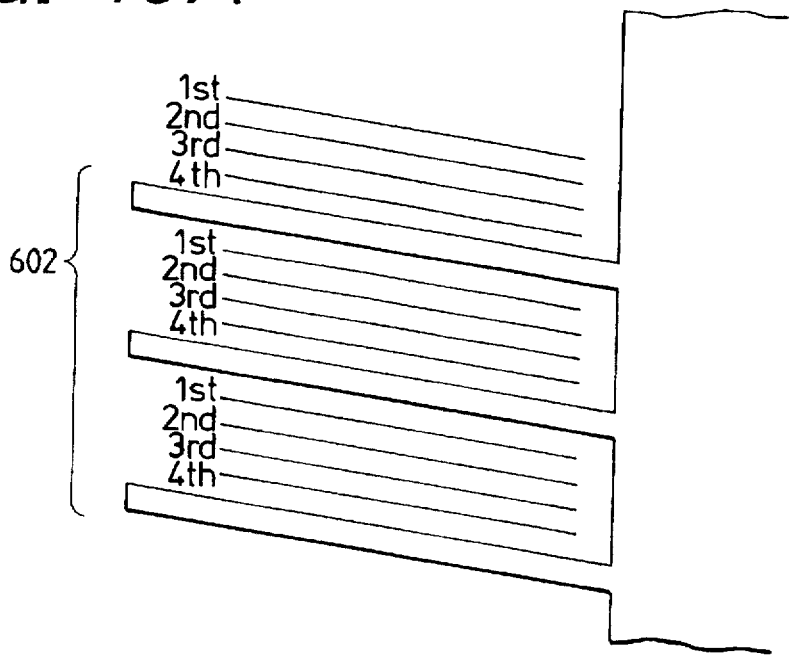
FIGS. 10A and 10B are explanatory diagrams of an operating mode of the paper ejection post-processing unit in FIG. 7.
Figure 10B:
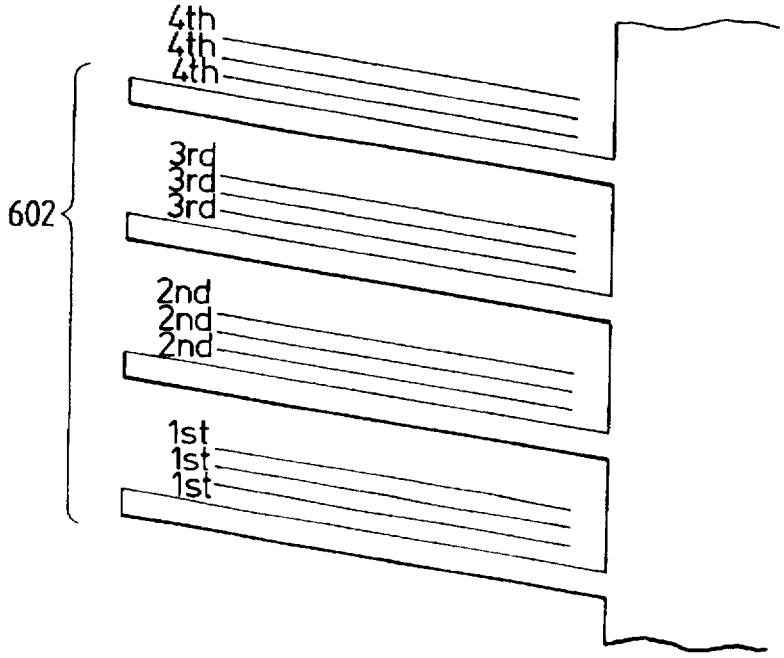

The well-known sorting operation by a combination of an automatic document feeder 400 (hereinafter, abbreviated to "RDF") and the sorter 600 will now be briefly explained with reference to FIGS. 10A to 12C. In FIGS. 10A and 10B, the non-sort bin 601 in which an explanation is unnecessary is not shown. Reference numerals written on the sides of the output papers stacked in the sort bin 602 show the orders of the originals set in the RDF 400.

In the embodiment, in addition to the non-sort mode in which the sorting operation is not performed, two kinds of sort modes such as sort mode and group mode are prepared. Therefore, total three kinds of stacking styles can be selected and executed for the sorter 600.

FIG. 10A shows the stacking style in the sort mode. It is assumed that the reference numerals written on the sides of the output papers stacked on the sort bin 602 indicate the corresponding original numbers. Since the RDF 400 has a construction such that the set originals are fed from the bottom original, the paper shown by the reference numeral 4 is stacked to the bottom of the sort bin 602. Such an operation is repeated a number of times corresponding to three bins in FIG. 10A. The paper shown by reference numeral 3 as a next original is stacked on the original of the numeral 4.

FIG. 10B shows the stacking style in the group mode. It is assumed that reference numerals written on the sides of the output papers stacked in the sort bin 602 indicate the corresponding original numbers. In the group mode, the output paper corresponding to the original is stacked onto each sort bin 602.

In addition to it, the sorter 600 in the embodiment has a stapling function and is controlled so that the stapling function can be executed only in the stacking style in the sort mode.

Figure 11A:
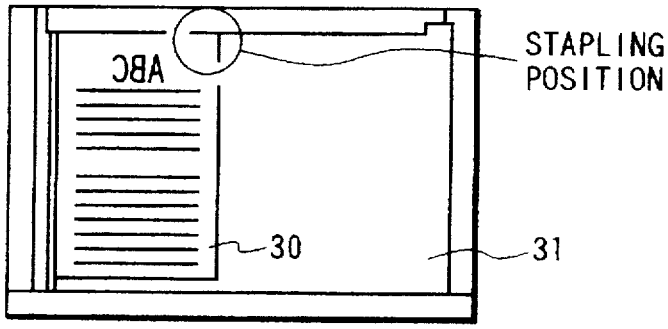
FIGS. 11A to 11C are explanatory diagrams of the relation between an original set on an original supporting glass plate and a stapling position in FIG. 7.
Figure 11B:
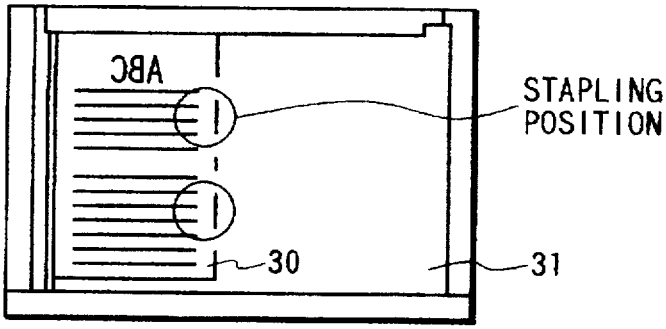
Figure 11C:
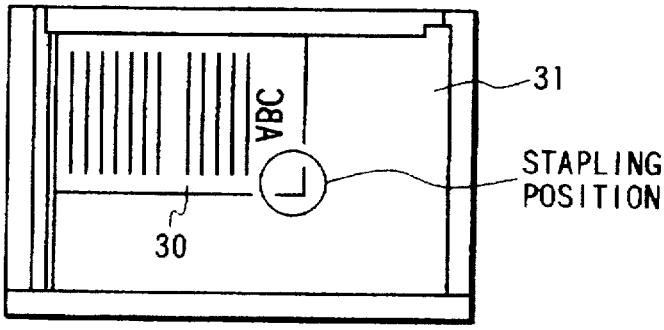
Figure 12A:
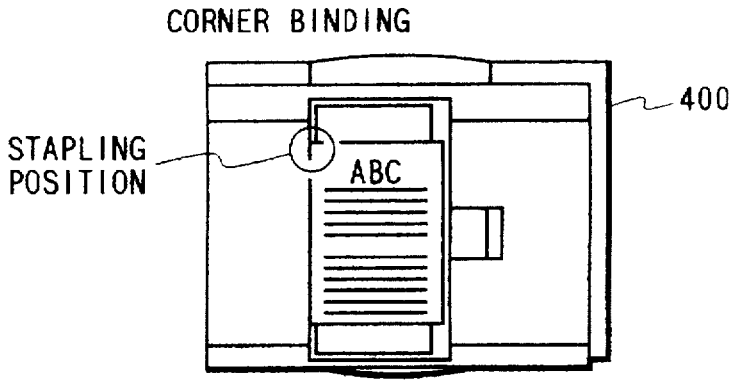
FIGS. 12A to 12C are explanatory diagrams of the relation between an original set in an automatic document feeder and a stapling position in FIG. 7.
Figure 12B:
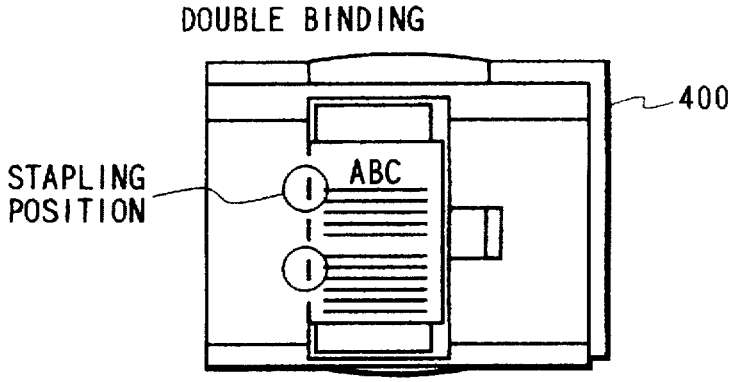
Figure 12C:
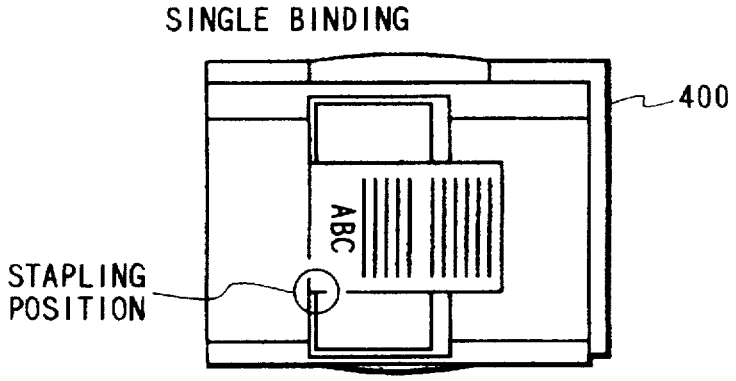

FIGS. 11A to 11C schematically show stapling positions on the original 30 stacked on the original supporting glass plate 31. In the corner binding (staple) in FIG. 11A, since the output paper is ejected in a state in which the top and the bottom are reversed, this side is stapled in the sorter 600. FIGS. 12A to 12C schematically show stapling positions on the originals when a state in which the originals have been set in the RDF 400 is seen from the top.

In any of the FIGS. 11A to 11C and FIGS. 12A to 12C, a stapling portion (not shown) sequentially enters the notches 602*c* and 602*d* for stapling, thereby stapling. When mentioning a specific example, both of the corner bindings of FIGS. 11A and 12A are controlled so as to staple by using the notch 602*d*.

Figures 2, 2A, 2B:
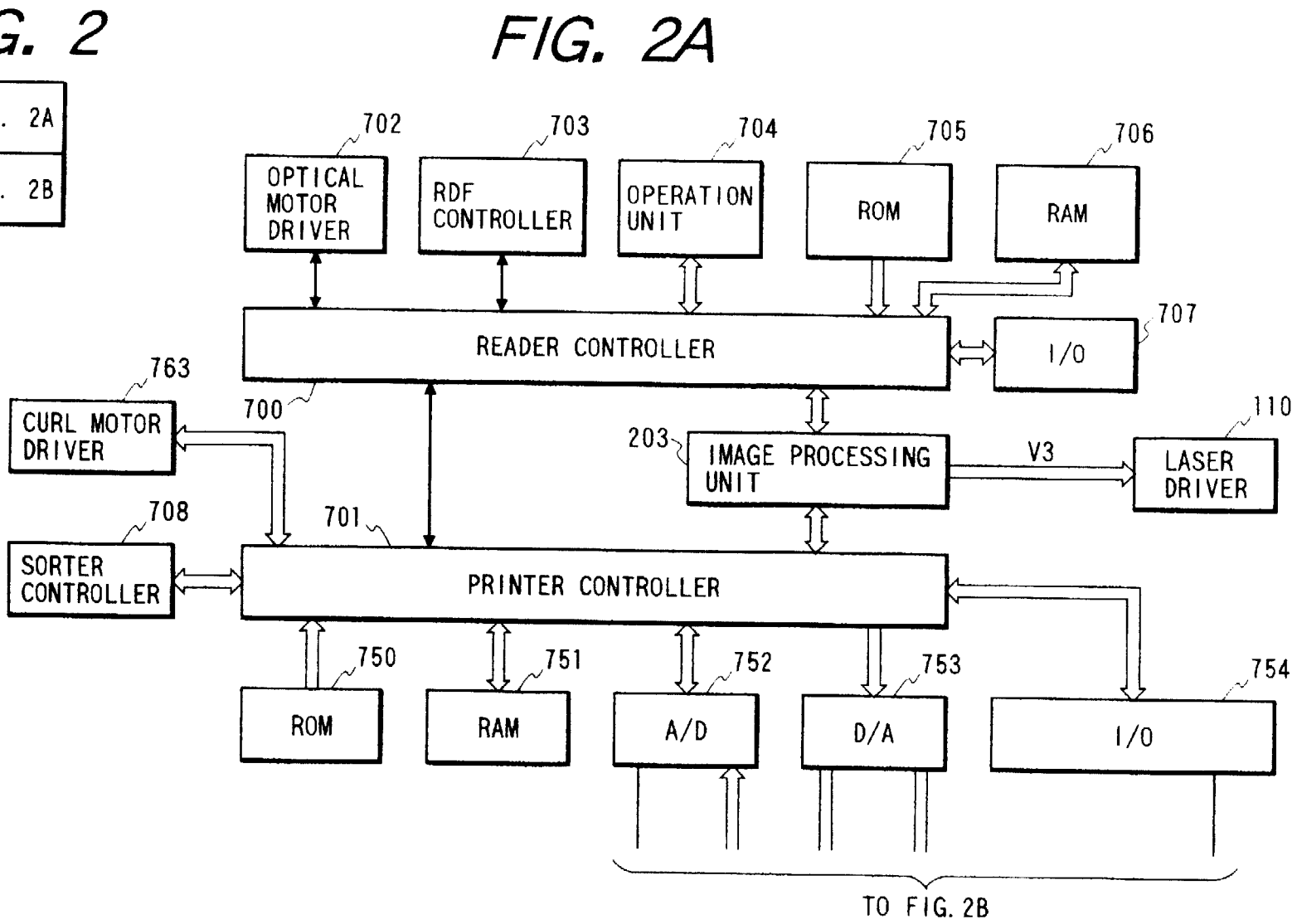
FIG. 2 which comprised of FIGS. 2A and 2B is a block diagram of a control system of the color image forming apparatus of FIG. 1.
Figure 2B:
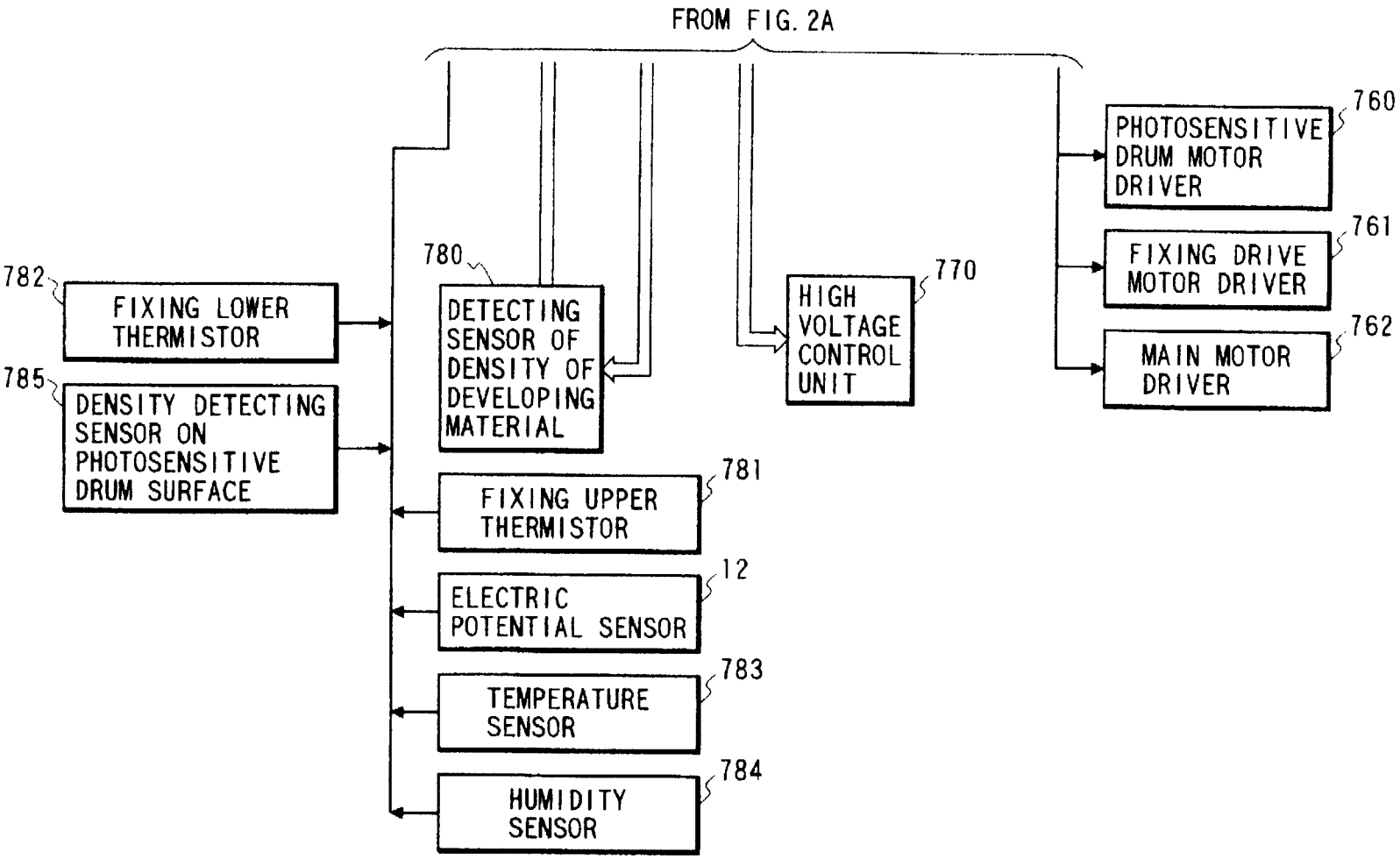

FIGS. 2A and 2B are block diagrams of a control system in the color image forming apparatus of an embodiment of the invention. The color image forming apparatus is mainly divided into two blocks from a viewpoint of a control. One is a reader controller 700 for mainly controlling the reader unit 201 and image processing unit 203. The other is a printer controller 701 for controlling the printer unit 202.

Reference numeral 702 denotes an optical motor driver for driving an optical motor (not shown) for moving scanning mirrors 32*a*, 32*b*, and 32*c* and the exposure lamp 32; 703 an RDF controller for controlling the automatic document feeder RDF 400 to automatically exchange originals; 704 an operation unit for setting an operating mode of the color image forming apparatus; 705 an ROM in which a control program of the reader controller 700 has been stored; 706 RAM to store data such as control values and the like; and 707 an I/O to drive loads such as an exposure lamp 32 and the like. The RAM 706 is backed up by a battery so that data can be held even when a power source is shut off.

A peripheral control unit of the printer controller 701 will now be described. Reference numeral 750 denotes ROM in which a control program of the printer controller 701 has been stored; 751 RAM to store data such as control values and the like; 752 the A/D converter for converting analog signals from the electric potential sensor 12, sensor 13 for detecting the light amount on the drum, and the like into digital data; 753 a D/A converter for outputting an analog set value to a high voltage control unit 770 or the like; and 754 an I/O for driving loads such as motor, clutch, and the like.

Reference numeral 708 denote a sorter controller for communicating with the printer controller 701 and executes a stacking control in accordance with a stacking style instruction of the non-sort mode, sort mode, or group mode set by the operation unit 704 and a staple control in accordance with a stapling instruction.

Reference numeral 763 denotes a curl motor driver to drive a curl motor as a drive source of the curl correcting section 500 (not shown) and the eccentric cam motor 507 shown in FIG. 8.

Figure 3:
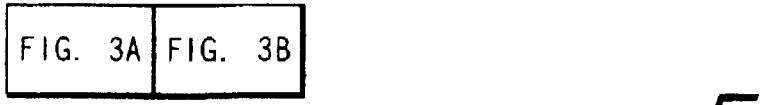
FIG. 3 which comprised of FIGS. 3A and 3B is a detailed control block diagram of an image processing unit shown in FIGS. 2A and 2B.
Figure 3A:
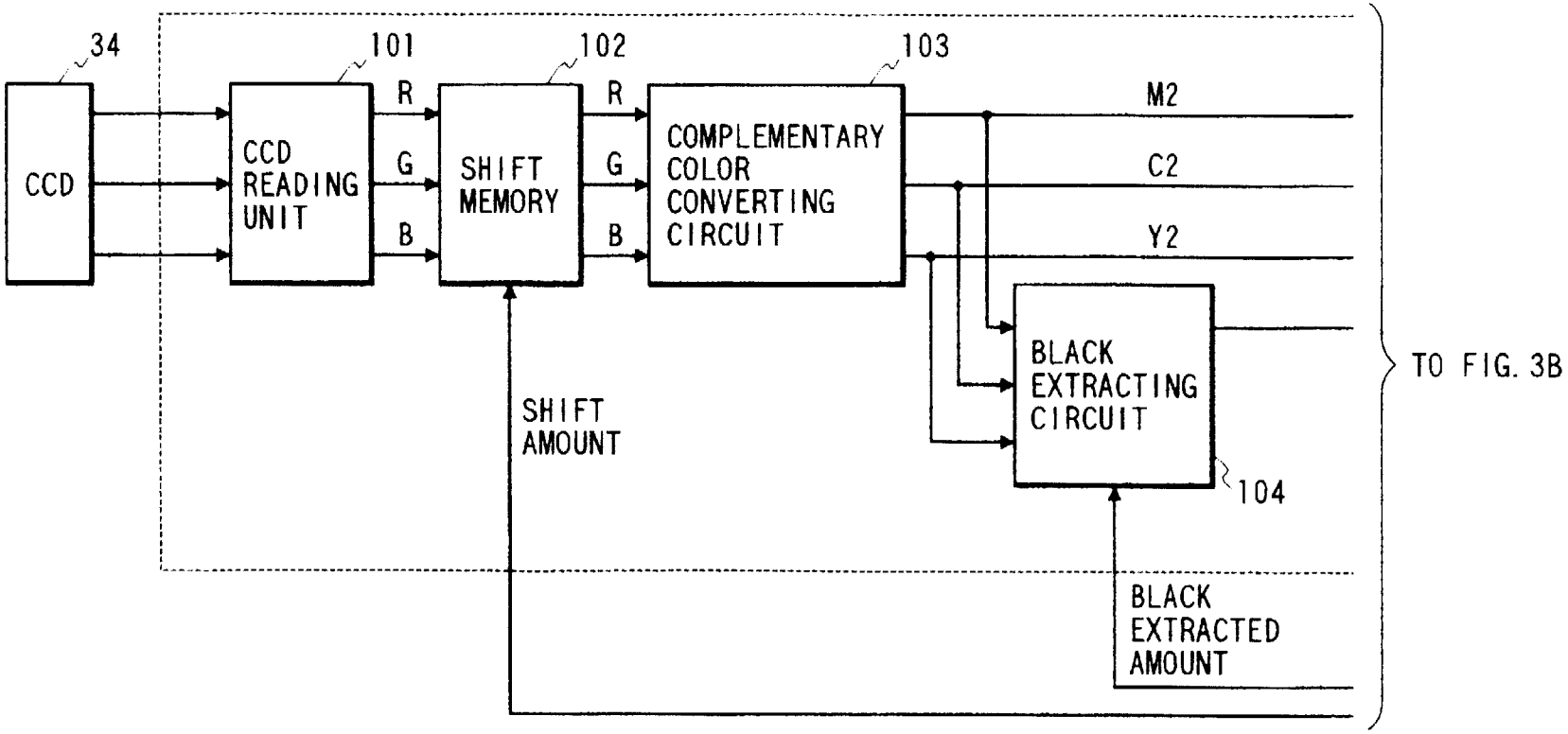
Figure 3B:
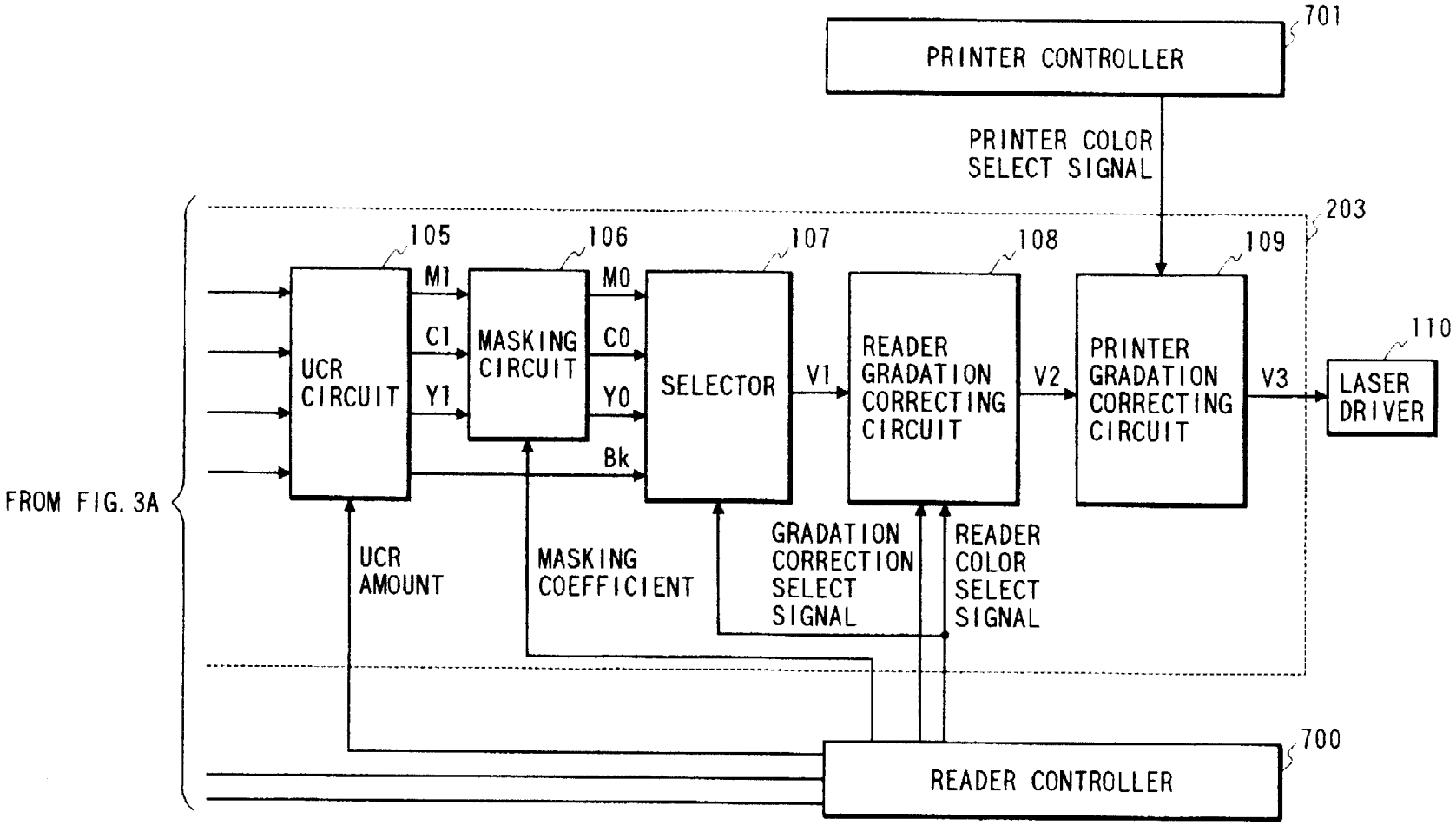

FIGS. 3A and 3B are block diagrams showing an example of a construction of the image processing unit 203 in the embodiment. In FIGS. 3A and 3B, reference numeral 101 denotes a CCD reading unit constructed by: amplifiers for amplifying analog RGB signals inputted from the full-color sensor 34 (see FIG. 1) mentioned above, respectively; A/D converters for converting the analog RGB signals into digital signals of, for example, eight bits; shading correcting circuits for performing a well-known shading correction; and the like. The CCD reading unit 101 generates the digital RGB image signals of the original image.

Reference numeral 102 denotes a shift memory for correcting, for example, deviations among colors and pixels of the RGB image signals inputted from the CCD reading unit 101 in accordance with a shift amount control signal from the reader controller 700. Reference numeral 103 denotes a complementary color converting circuit for converting the RGB image signals inputted from the shift memory 102 into MCY image signals. Reference numeral 104 denotes a black extracting circuit for extracting a black region of the image from the MCY (magenta, cyan, yellow) image signals inputted from the complementary color converting circuit 103 in accordance with a black extraction signal inputted from the reader controller 700 and generating a Bk (black) image signal for the extracted black region.

Reference numeral 105 denotes a UCR circuit for performing an undercolor removing (UCR) process to the MCY image signals inputted from the complementary color converting circuit 103 in accordance with the Bk image signal inputted from the black extracting circuit 104 and a UCR amount control signal inputted from the reader controller 700. Namely, the black extracting circuit 104 and UCR circuit 105 don't overlap the extracted black region to the toners of three colors of MCY but replaces it to the Bk toner and forms an image, thereby improving a color reproducibility.

The Bk image signal which is generated from the black extracting circuit 104 is determined by the following equation (1).

$$Bk=A\bullet min(C2, Y2, M2) \quad \ldots (1)$$

In the equation (1), A denotes a black extraction coefficient and C2, Y2, and M2 indicate MCY image signals outputted from the complementary color converting circuit 103. The black extraction coefficient A is determined by a black extraction amount control signal which is designated from the reader controller 700.

The MCY image signals which are outputted from the UCR circuit 105 are determined by the following equations (2).

$$M1=B1\cdot(M2-D1\bullet Bk)\ C1=B2\bullet(C2-D2\bullet Bk)\ Y1=B3\bullet(Y2-D3\bullet Bk) \quad \ldots (2)$$

In the equations (2), M2, C2,and Y2 denote the MCY image signals which are outputted from the complementary color converting circuit 103; M1, C1, and Y1 indicate MCY image signals which are outputted from the UCR circuit 105; and coefficients B1, B2, B3, D1, D2, and D3 are determined by a UCR amount control signal from the reader controller 700.

Reference numeral 106 denotes a masking circuit for performing a masking process to the MCY image signals inputted from the UCR circuit 105 in accordance with a masking coefficient control signal inputted from the reader controller 700 in order to eliminate turbidity components of the toners which are used and to correct RGB filter characteristics of a CCD. The MCY image signals which are outputted from the masking circuit 106 are expressed by the following equation (3).

$$\begin{vmatrix} M0 \\ C0 \\ Y0 \end{vmatrix} = \begin{vmatrix} a11 & a12 & a13 \\ a21 & a22 & a23 \\ a31 & a32 & a33 \end{vmatrix} \begin{vmatrix} M1 \\ C1 \\ Y1 \end{vmatrix} \quad (3)$$

In the equation (3), all to a33 denote masking coefficients; M1, C1, and Y1 the MCY image signals outputted from the UCR circuit 105; M0, C0, and Y0 indicate the MCY image signals which are outputted from the masking circuit 106; and the masking coefficients all to a33 are determined by the masking coefficient control signal which is designated from the reader controller 700.

Reference numeral 107 denotes a selector for selecting the image signal of one color from the image signals of M, C, Y, and Bk inputted from the masking circuit 106 and black extracting circuit 104 in accordance with a color selection signal inputted from the reader controller 700 to a selection terminal 107 and generates an image signal V1.

Figure 4:
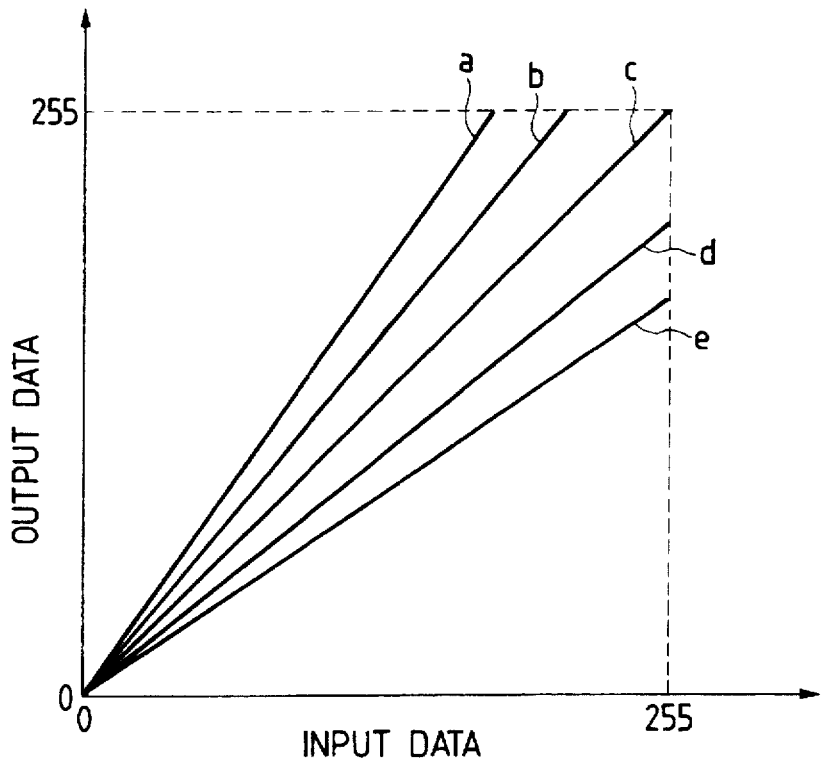
FIG. 4 is a gradation correcting characteristics diagram showing an example of input/output signals in a reader gradation correcting circuit in FIGS. 3A and 3B.

Reference numeral 108 denotes a reader gradation correcting circuit for performing a gradation correction as shown in FIG. 4 to the image signal V1 inputted from the selector 107 and outputting an image signal V2. For example, the reader gradation correcting circuit 108 executes a density correction to the image signal by any one of converting characteristics a to e in FIG. 4 selected on the basis of a gradation correction selection signal designated from the reader controller 700. The setting in the reader gradation correcting circuit 108 is determined by the setting of an image density of an operation unit, which will be explained hereinlater.

Figure 5:
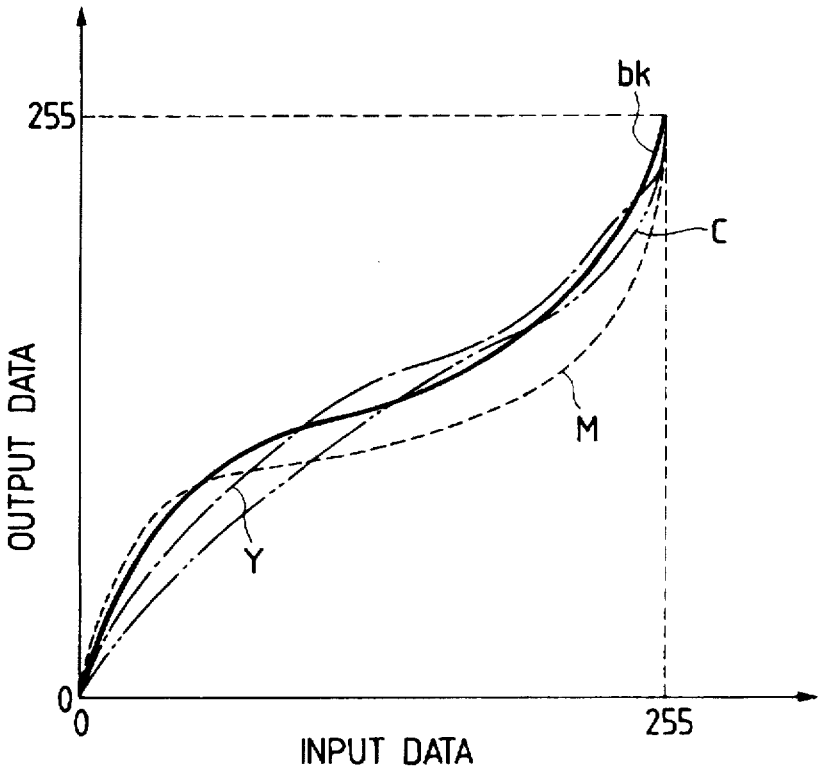
FIG. 5 is a gradation correcting characteristics diagram showing an example of input/output signals in a printer gradation correcting circuit in FIGS. 3A and 3B.

Reference numeral 109 denotes a printer gradation correcting circuit for selecting any one of M, C, Y, and Bk of gamma converting characteristics showing an example in FIG. 5 in accordance with a printer color selection signal inputted from the printer controller 701 and corrects the image signal.

Reference numeral 110 denotes a laser driver included in the foregoing laser exposure optical system 3 (see FIG. 1). The laser driver 110 forms a latent image onto the photosensitive drum 1 by modulating a semiconductor laser on the basis of an image signal V3 inputted from the printer gradation correcting circuit 109.

Figure 6:
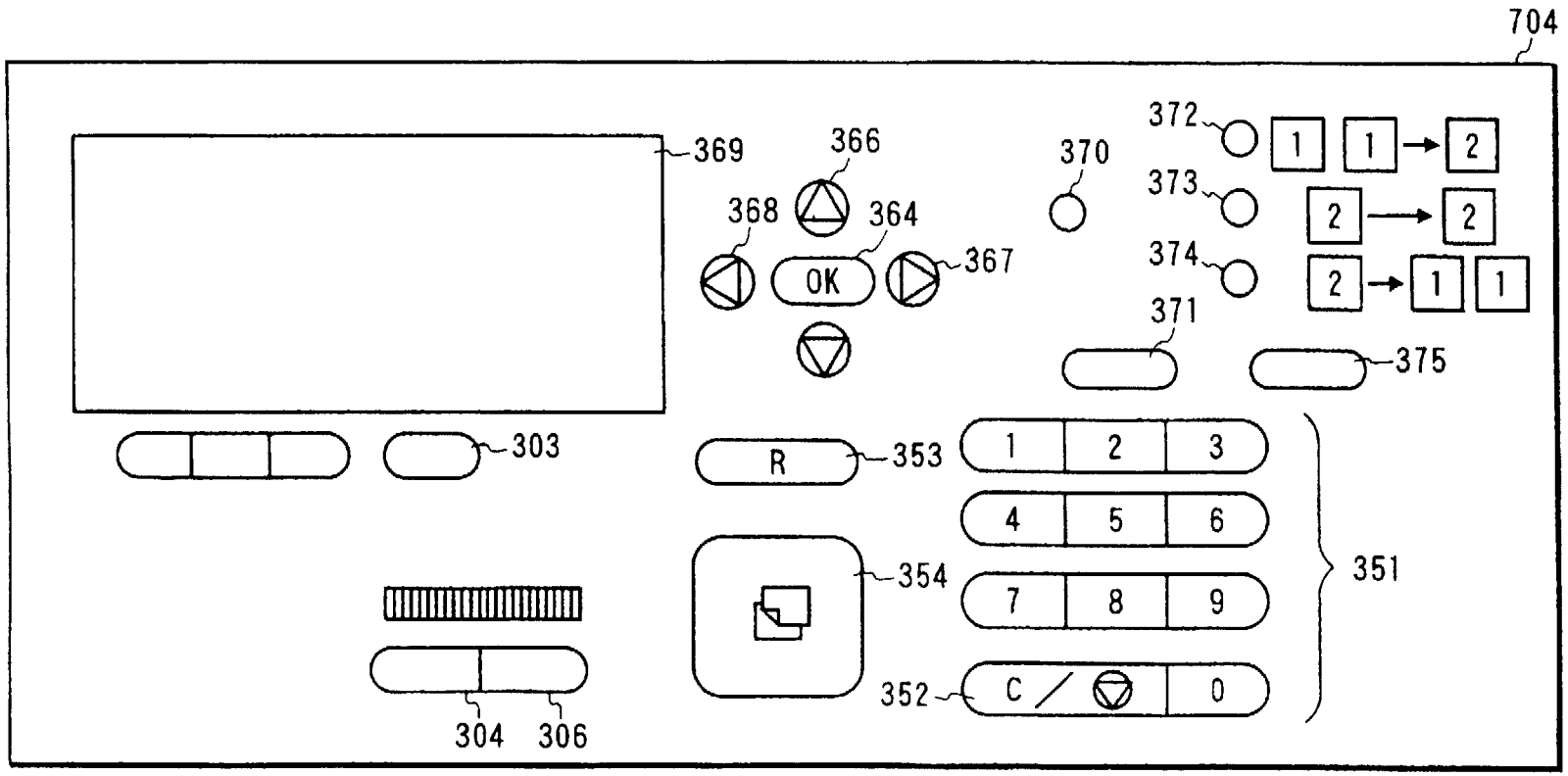
FIG. 6 is a schematic plan view of an operation unit shown in FIGS. 2A and 2B.

FIG. 6 shows the operation unit 704 of the color image forming apparatus. In FIG. 6, reference numeral 351 denotes a ten-key which is used to input numerical values for setting the number of images to be formed and the mode; 352 a clear/stop key which is used to stop the set number of images to be formed or to stop the image forming operation; 353 a reset key to return the number of images to be formed, operating mode, and mode of a selected paper feed stage or the like which have been set to specified values; and 354 a start key. By depressing the start key 354, the image forming operation is started.

Reference numeral 369 denotes a display panel constructed by a liquid crystal or the like. In order to make a detailed mode setting easy, display contents are changed in accordance with the set mode. In the embodiment, a cursor of a display panel 369 is moved by cursor keys 366 to 368 and the setting is determined by an OK key 364. Such a setting method can be also realized by a touch panel.

Reference numeral 371 denotes a paper kind setting key which is depressed when an image is formed to a recording material that is thicker than an ordinary thickness. When a thick paper mode is set by the paper kind setting key 371, an LED 370 is lit on. In the embodiment, although only the thick paper mode can be set, a function can be also expanded so that modes for a sheet for OHP or another special paper can be set.

Reference numeral 375 denotes a both-side mode setting key which can set four kinds of both-side modes such as "one-one mode" for performing a one-side output from a one-side original, "one-both mode" for performing a both-side output from a one-side original, "both-both mode" for performing a both-side output from a both-side original, and "both-one mode" for performing two one-side outputs from a both-side original. LEDs 372 to 374 are lit on in accordance with the set both-side mode and are controlled as follows. In the "one-one mode", all of the LEDs 372 to 374 are lit off. In the "one-both mode", only the LED 372 is lit on. In the "both-both mode", only the LED 373 is lit on. In the "both-one" mode, only the LED 374 is lit on.

(Specific example of image formation)

As a specific example, explanation will now be made with respect to the image forming operations of four colors for a normal paper in which the thick paper mode is not set in the "one-one mode" in which the automatic document feeder RDF 400 is not used.

In this case, since the recording material to form an image is a normal paper, the speed is set into the fixing drive motor driver 761 so as to be set to the same speed VFN as the image forming speed (processing speed) VP of the photosensitive drum 1.

After the operator set the number of images to be formed by the ten-key 351, when he selects the paper feeding stage by a paper selecting key 303 and instructs to start the operation by the start key 354, the printer controller 701 instructs the driving to drivers of drive motors which are necessary to form an image, for example, a photosensitive drum drive motor, a fixing drive motor, a paper feed driving motor, and a main drive motor. Subsequently, after the driving states of those drive motors were stabilized, the feeding operation of the recording material P is started from the designated paper feeding stage (recording material cassette *7a*, *7b*, etc.). In this instance, the reader unit 201 sets the foregoing shift amount, black extraction amount, UCR amount, reader color selection signal, and the like into the respective blocks of the image processing unit 203, so that an image signal for magenta as a developing color of the first color in the 4-color mode can be formed. The reader gradation correcting circuit 108 selects any one of the converting characteristics of (a to e) shown in FIG. 4 corresponding to the designated contents of density keys 304 and 306 of the operation unit 704. On the other hand, converting characteristics m shown in FIG. 5 are selected for the printer gradation correcting circuit 109.

The recording material P fed from the designated paper feeding stage is sent so as to match the timing with the optical scanning operation of the reader unit 201 by a resist roller 50 and is adsorbed to the transfer sheet *5f* by the adsorbing roller *5g* as an electrode which faces the adsorption charging unit *5c*.

Original information read by the reader unit 201 is processed by the image forming unit 203 and is irradiated as a laser beam onto the photosensitive drum 1 which was uniformly charged by the charging unit 2, a latent image is formed, and is developed by the magenta developing unit *4m*. The developed image information is transferred by the transfer charging unit *5b* onto the recording material P which had already been adsorbed. The image forming operations such as reading of the M (magenta) image, formation of the latent image, development, and transfer are executed for a period of time during which the photosensitive drum 1 and transfer drum *5a* rotate once. Similarly, those image forming operations are also executed with regard to each of the remaining three colors C (cyan), Y (yellow), and Bk (black). In this instance, it is now assumed that the setting for the image processing unit 203 is performed every image formation.

As mentioned above, the recording paper P on which the images of four colors have been transferred is separated from the transfer sheet *5f*. In this instance, the adsorbing force between the transfer sheet *5f* and the recording material P is weakened by the separation charging unit *5h*. The transfer sheet *5f* is deformed by the separation pushing-up roller *8b*, a curvature separation is performed, and the recording paper P is separated from the transfer sheet *5f* by the separating claw *8a*.

The recording material P separated in this manner is conveyed to the thermal roller fixing device 9 by the recording material conveying unit *9g* which executes the conveying operation at the same speed (VP) as that of the transfer drum *5a* and is fixed at the fixing speed VFN=VP. Subsequently, the curl of the recording material is corrected by the paper ejection curl correcting section 500. After that, the recording material is ejected to the sorter 600.

(Operations of curl correcting section 500 and sorter 600)

A control method about the curl correcting section 500 and sorter 600 in the embodiment will now be described in detail hereinbelow. First, an outline of a curl correction control in the curl correcting section 500 will be described in detail with reference to flowcharts.

As shown in FIG. 8, in many cases, the paper as a recording material which was outputted in a state in which an image has been formed on one side is ejected from the thermal roller fixing unit 9 in a state of the positive curl (curl in a downward convex shape). It is well known that the positive curl of the paper occurs because the toner which was heated and melted by the thermal roller fixing unit 9 shrinks by an air cooling after the paper was ejected. It is also well known that a curl amount and a curl direction change by an image density (toner amount), a kind of paper (material, rigidity, thickness, size, spacing direction, etc.), and an ambient humidity environment and have a correlation between them and the foregoing change factors. In the embodiment, the toner amount is detected as a processing amount of the image forming apparatus which becomes a factor of the occurrence of the curl. The correction amount of the curl is controlled by using the detected toner amount or the like. In addition to the toner amount, various processing amounts which become factors of the occurrence of the curl are detected as processing amounts of the image forming apparatus which become the factors of the occurrence of the curl and can be used to control the correction amount of the curl.

First, as a specific example of the occurrence of the curl, a growing direction of the curl when the feeding direction of a paper of the A4 size at the same image density is changed will be explained. In case of the A4 lateral feeding size (feeding direction, 210 mm), as shown in FIG. 8, the curl grows in parallel with a side which crosses perpendicularly to the paper conveying direction. On the other hand, in case of the A4 vertical feeding size (feeding direction, 297 mm), the curl grows along the side which is parallel with the paper conveying direction. It is considered that such a growth occurs due to an influence by spaces of the paper mentioned above.

According to the invention, in addition to such factors of the growth of the curl, the operating mode of the sorter 600, the presence or absence of the stapling process, and the partial image density (toner amount) are integratedly judged and an optimum curl correction control is performed, thereby eventually accomplishing the improvement of the quality in the final style of the output paper. The curl correction control is executed also in consideration of spaces which are presumed from the paper size. When it is judged that the curl cannot be perfectly eliminated, the stapling operation is inhibited, thereby preventing the defective staple.

First, a calculating method of the partial image density (toner amount) in the embodiment will be described. For simplicity of explanation, it is now assumed that the partial image density (toner amount) is divided into two densities in the paper conveying direction and they are calculated and that the penetration amount X in FIG. 8 to decide the curl correction amount can be switched to three stages.

Figures 13, 13A:
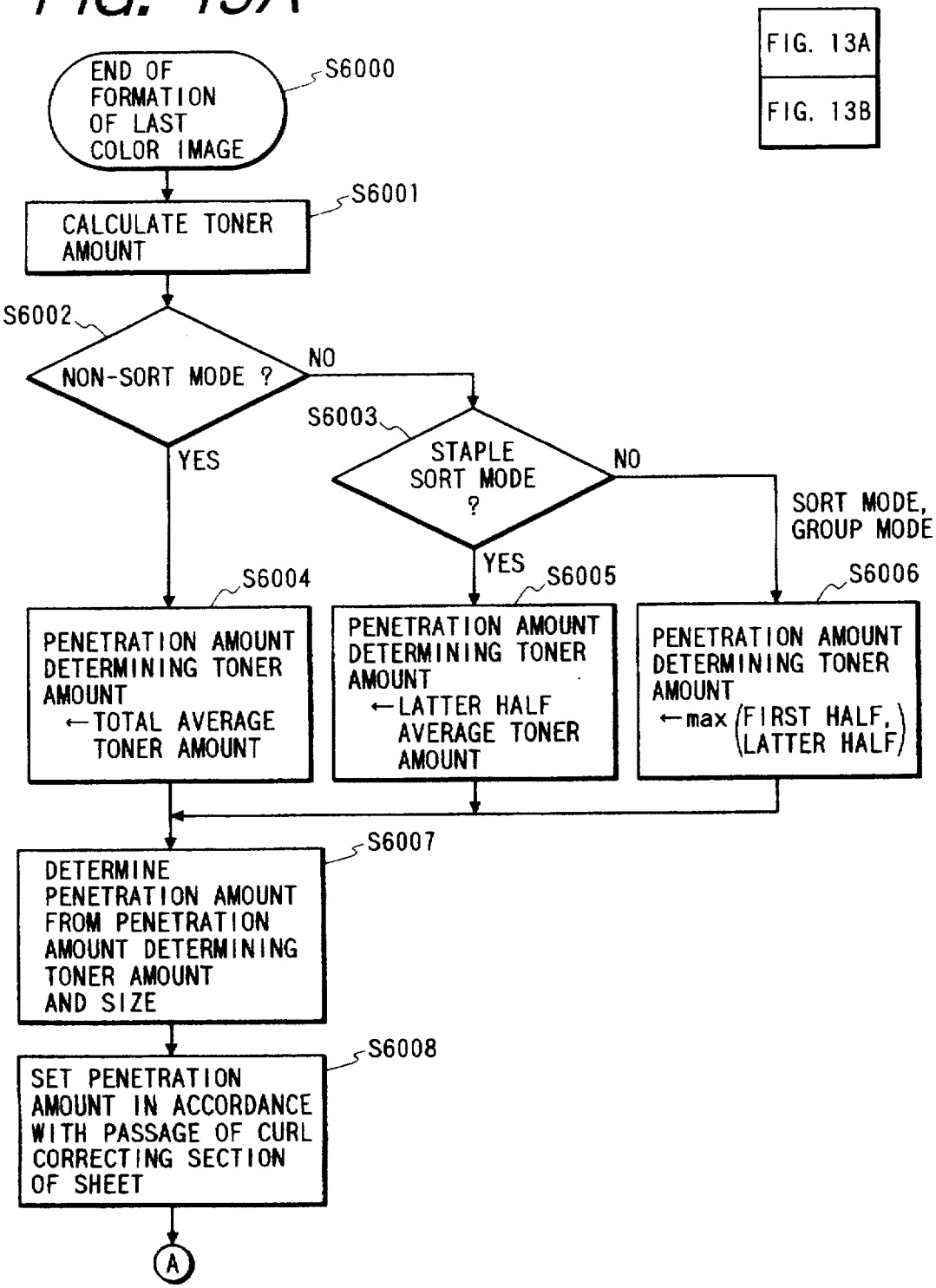
FIG. 13 which comprised of FIGS. 13A and 13B is a flowchart for explaining a control of the curl correcting section and paper ejection post-processing unit in FIG. 7.
Figure 13B:
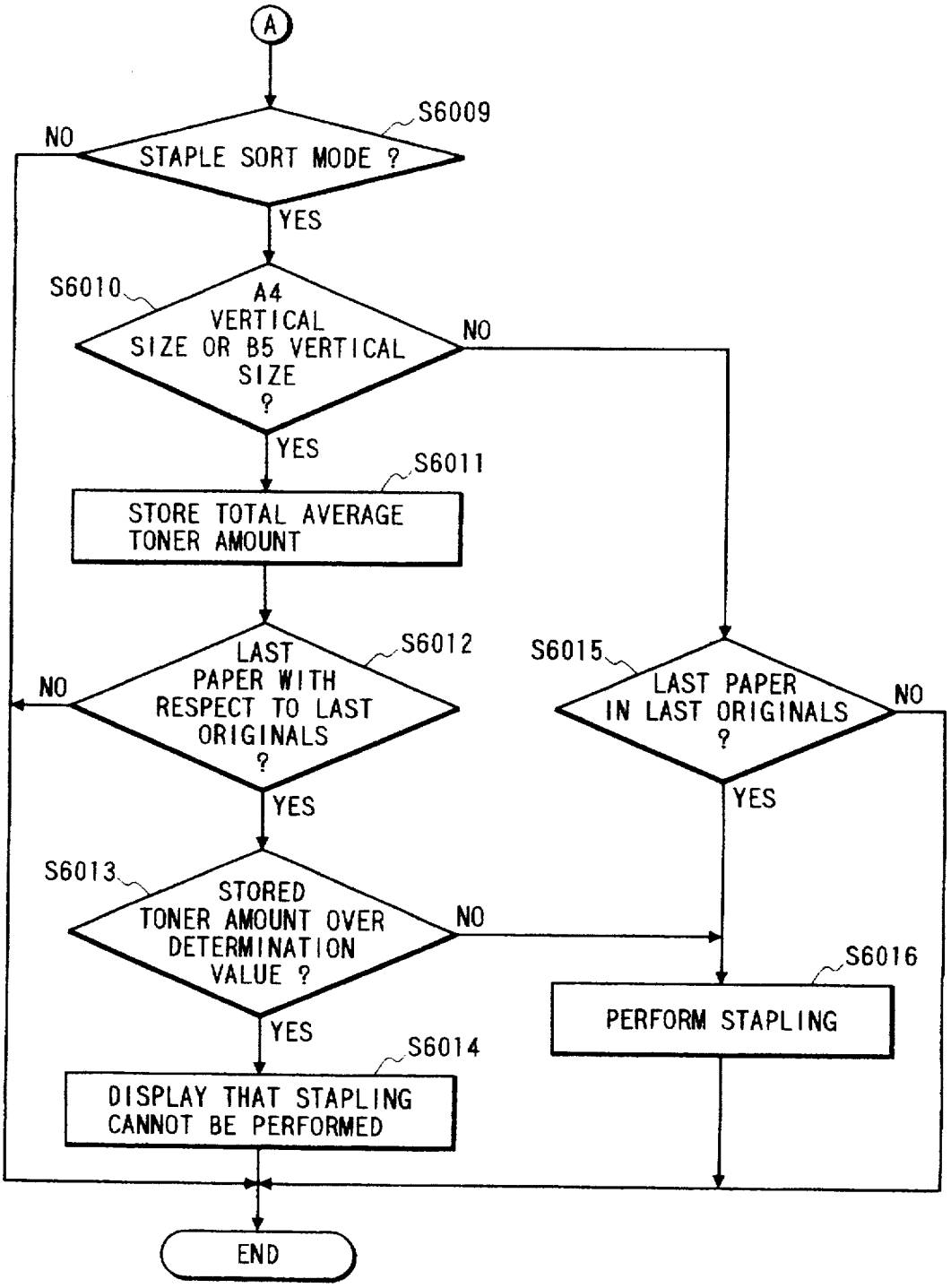
Figure 14:
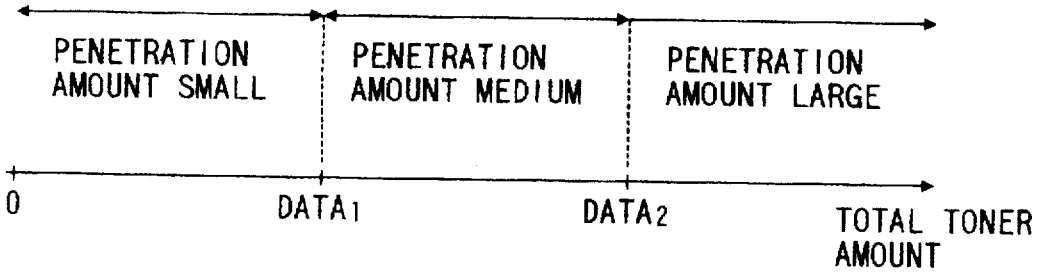
FIG. 14 is an explanatory diagram of the relation between a control amount of the curl correcting section and a detection amount of a toner in FIG. 7.

Explanation will now be made hereinbelow with reference to a flowchart of FIGS. 13A, 13B and FIG. 14. FIGS. 13A and 13B are the flowcharts for the curl correction control. The curl correction control is started when the image formation of the last color is finished (S6000).

When the image density (toner amount) is calculated, an electric potential at the time of the image formation is first sampled by the electric potential sensor 12. Sampled electric potentials are averaged. After that, the average value is converted into the toner amount from the relation between the electric potential amounts derived from the experimental results and the toner amount. The "toner amount" used here denotes a toner amount per unit area and it is assumed that so long as a uniform density, even if the paper size changes, the same numerical value is shown. When forming a color image (four colors), the toner amount is expressed by the sum of a magenta toner amount, a cyan toner amount, a yellow toner amount, and a black toner amount. The operation to calculate the toner amount is executed after completion of the formation of the black image. Three toner amounts of a first half average toner amount (TNRtop) of the former half in the paper conveying direction, a latter half average toner amount (TNRbottom) of the latter half in the paper conveying direction, and a total average toner amount (TNRtotal) in the whole region in the paper conveying direction are calculated (S6001).

Subsequently, the calculated toner amounts are selectively used in accordance with the stacking mode for the sorter 600. A determination of whether it is in the non-sort mode is made (S6002). In the non-sort mode, the paper is ejected to the non-sort bin 601 in which the registration operation cannot be performed and importance is put on a stacking amount rather than a stacking quality. In the non-sort mode, therefore, the total average toner amount is used as a toner amount to decide the penetration amount X (S6004).

In the sort mode, it is determined whether it is in the staple mode (S6003). If in the staple sort mode for performing the stapling operation at the end of a job, since the latter half portion of the paper is stapled, the latter half average toner amount is used as a toner amount to decide the penetration amount X (S6005).

In case of neither the non-sort mode nor the staple sort mode, namely, in case of the sort mode or group mode for ejecting the papers to the sort bin 602, in order to improve the stacking quality, a larger one of the values of the first half average toner amount and the latter half average toner amount is used as a toner amount to decide the penetration amount X (S6006). With this method, a curl correction quality, particularly, when the toner amount is deviated is extremely improved as compared with the case of using the total average toner amount.

As mentioned above, a target to sample the toner amount on the paper to be used to decide the penetration amount for determining the curl correcting performance is changed in accordance with the mode. A method of deciding the penetration amount X in accordance with the toner amount will now be described with reference to FIG. 14.

In the embodiment, it is assumed that the penetration amount X can be switched to three stages and they are expressed by "small penetration amount", "medium penetration amount", and "large penetration amount". As mentioned above, since the curl amount is proportional to the toner amount, when the total toner amount is shown by an axis of abscissa, switching point data 1 between the small penetration amount and the medium penetration amount and switching point data 2 between the medium penetration amount and the large penetration amount exist. Since the curl amount also depends on the paper size and spaces, the data 1 and data 2 according to the paper sizes are determined. They are shown in the following Table 1. Since the curl amount also depends on the kind of paper, thickness, and the like, data corresponding to the Table 1 is prepared every kind of recording material such as normal paper, OHP sheet, thick paper, and the like on which an image can be formed.

TABLE 1

| Paper size | Data 1 | Data 2 |
|---|---|---|
| A3 vertical | $S_{11}$ | $S_{12}$ |
| B4 vertical | $S_{21}$ | $S_{22}$ |
| A4 vertical | $S_{31}$ | $S_{32}$ |
| A4 lateral | $S_{41}$ | $S_{42}$ |
| B5 vertical | $S_{51}$ | $S_{52}$ |
| B4 lateral | $S_{61}$ | $S_{62}$ |

From the Table 1, the penetration amount switching data 1 and 2 of every paper size are determined and the penetration amount X is decided from the toner amount for determining the penetration amount mentioned above (S6007). The decided penetration amount X is set each time the paper passes the curl correcting section 500 and the curl correction control is executed for each paper (S6008).

After that, a check is made to see if the operating mode is the staple sort mode (S6009). In case of the staple sort mode and when the size is neither the A4 vertical feeding size (feeding direction, 297 mm) nor the B5 vertical feeding size (feeding direction, 257 mm) (S6010), the stapling operation is executed (S6016) under conditions such that the original is the last original and the paper is the last paper as a prerequisite (S6015).

In case of the staple sort mode and when the size is the A4 vertical feeding size or the B5 vertical feeding size (S6010), the total average toner amount is stored as a toner amount for judging about the inhibition of the stapling operation (S6011). In the mechanism for performing the curl correction in the paper conveying direction as in the embodiment, when the whole toner amount is large and the size is the A4 vertical size or B5 vertical size, there is a situation such that the curl correction control is difficult to be sufficiently performed to the paper. Therefore, the total average toner amount is stored as data for judging the inhibition of the stapling operation.

Figure 15:
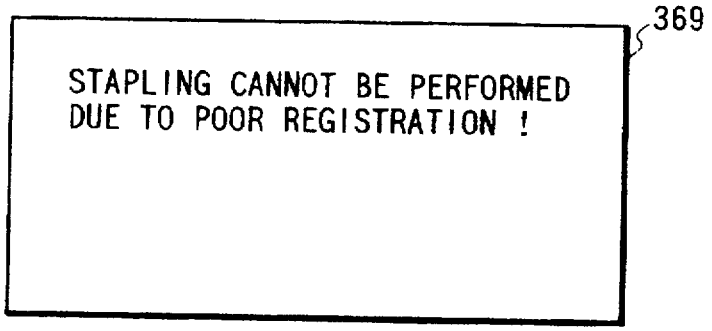
FIG. 15 is an explanatory diagram of a display example when a message indicative of impossibility of the stapling is displayed in step in FIGS. 13A and 13B.
Figure 16:
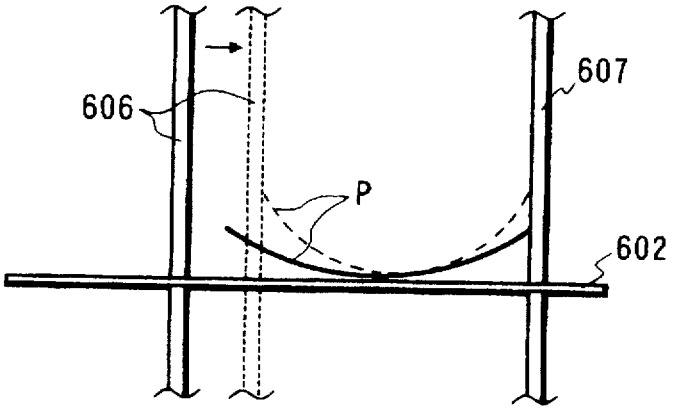
FIG. 16 is a diagram for explaining a sheet registering operation in a sorter.
Figure 17:
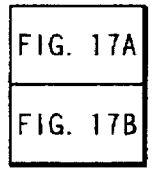
FIG. 17 which comprised of FIGS. 17A and 17B is a flowchart for explaining another example of a control of the curl correcting section and the paper ejection post-processing unit in FIG. 7.
Figure 17A:
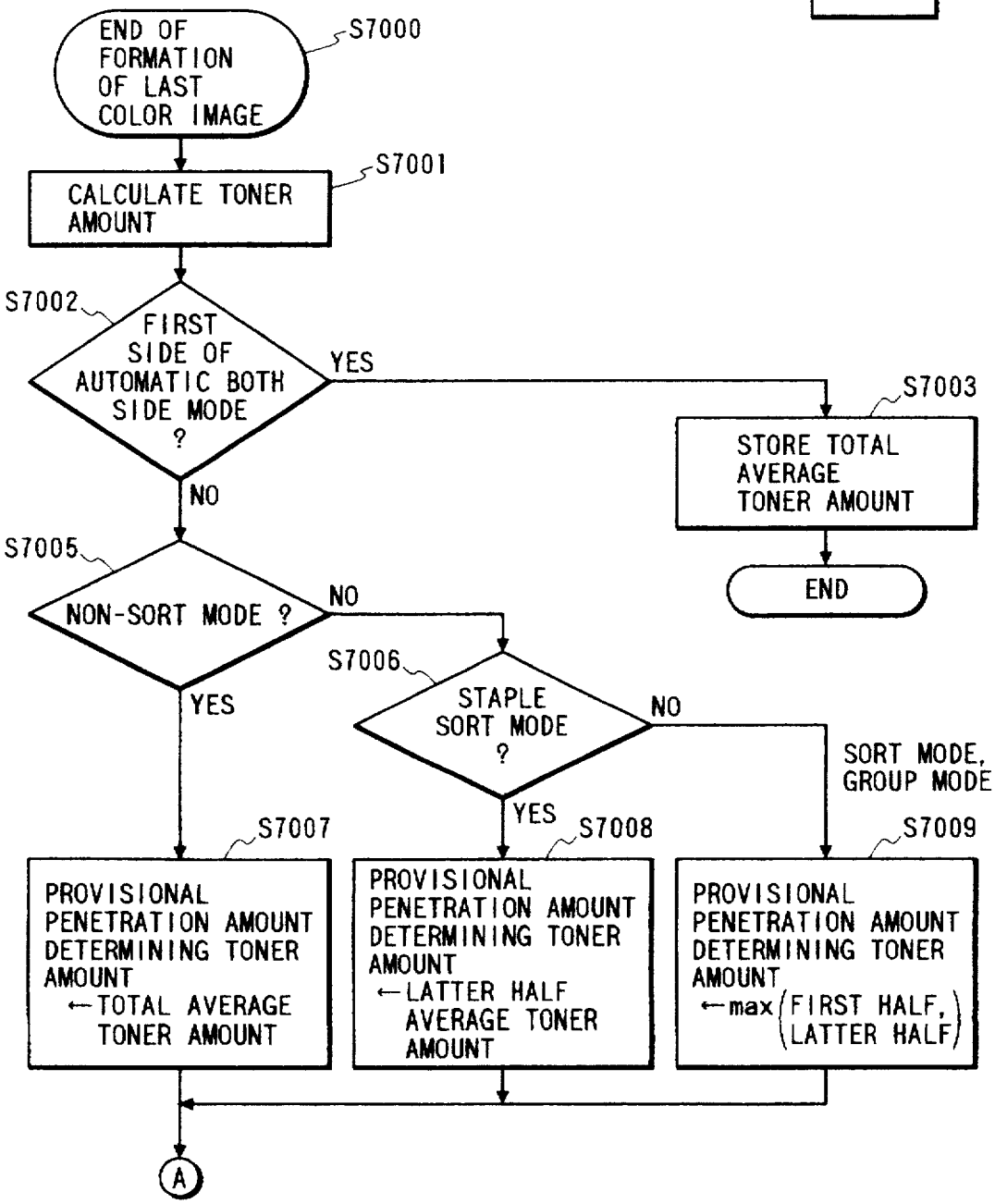
Figure 17B:
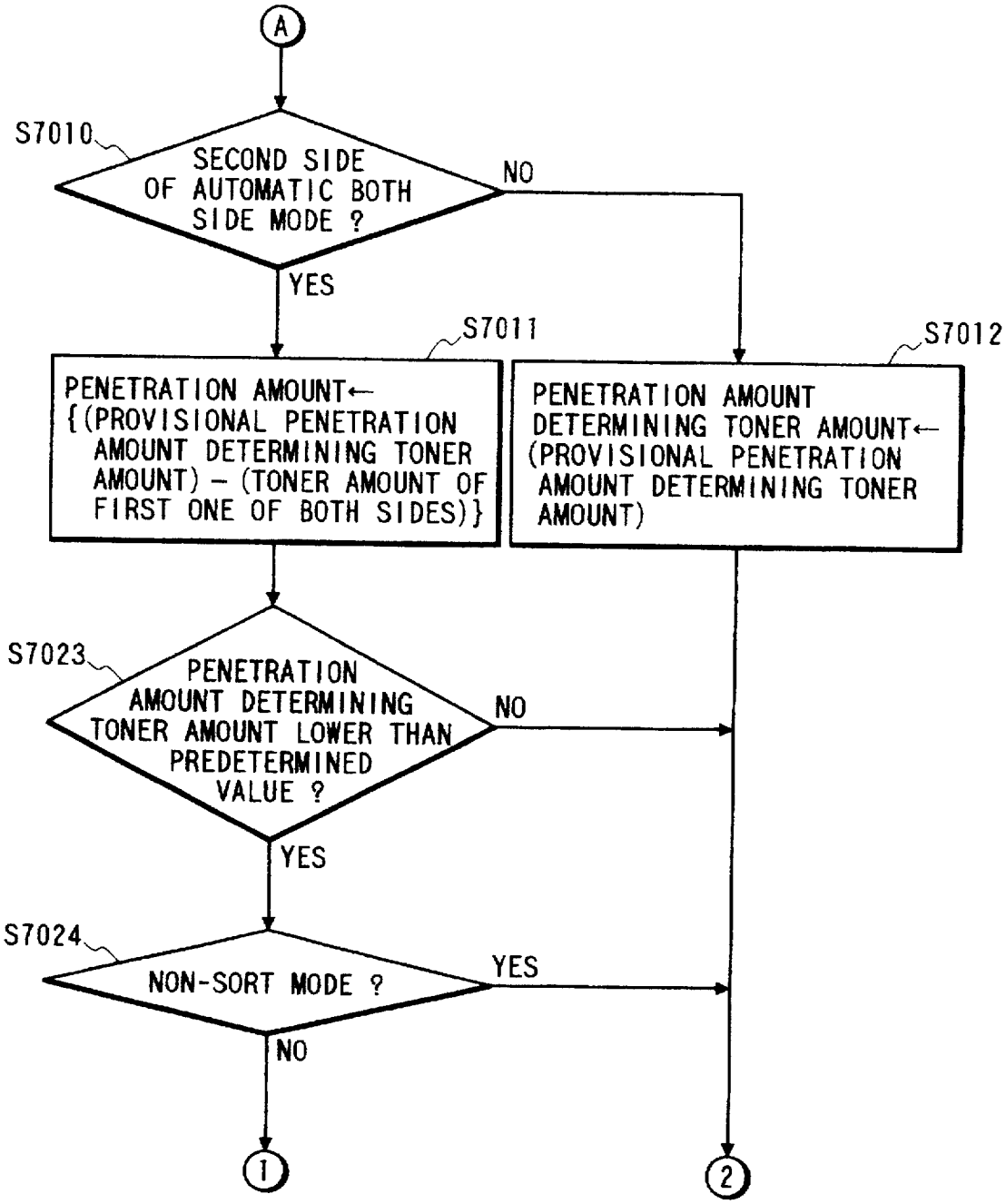
Figure 18:
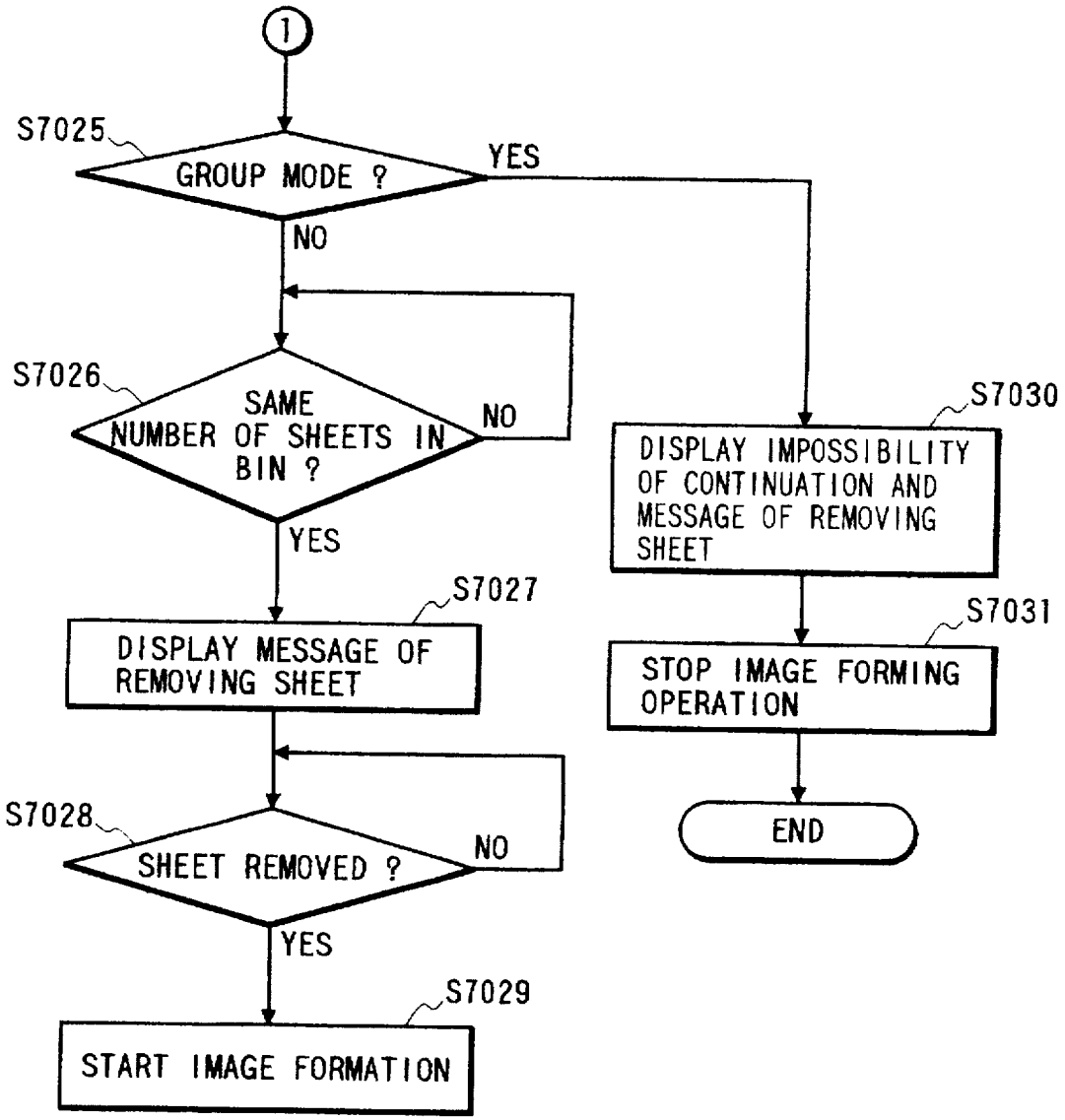
FIG. 18 is a flowchart for explaining another example of a control of the curl correcting section and a paper ejection post-processing unit in FIG. 7.
Figure 19:
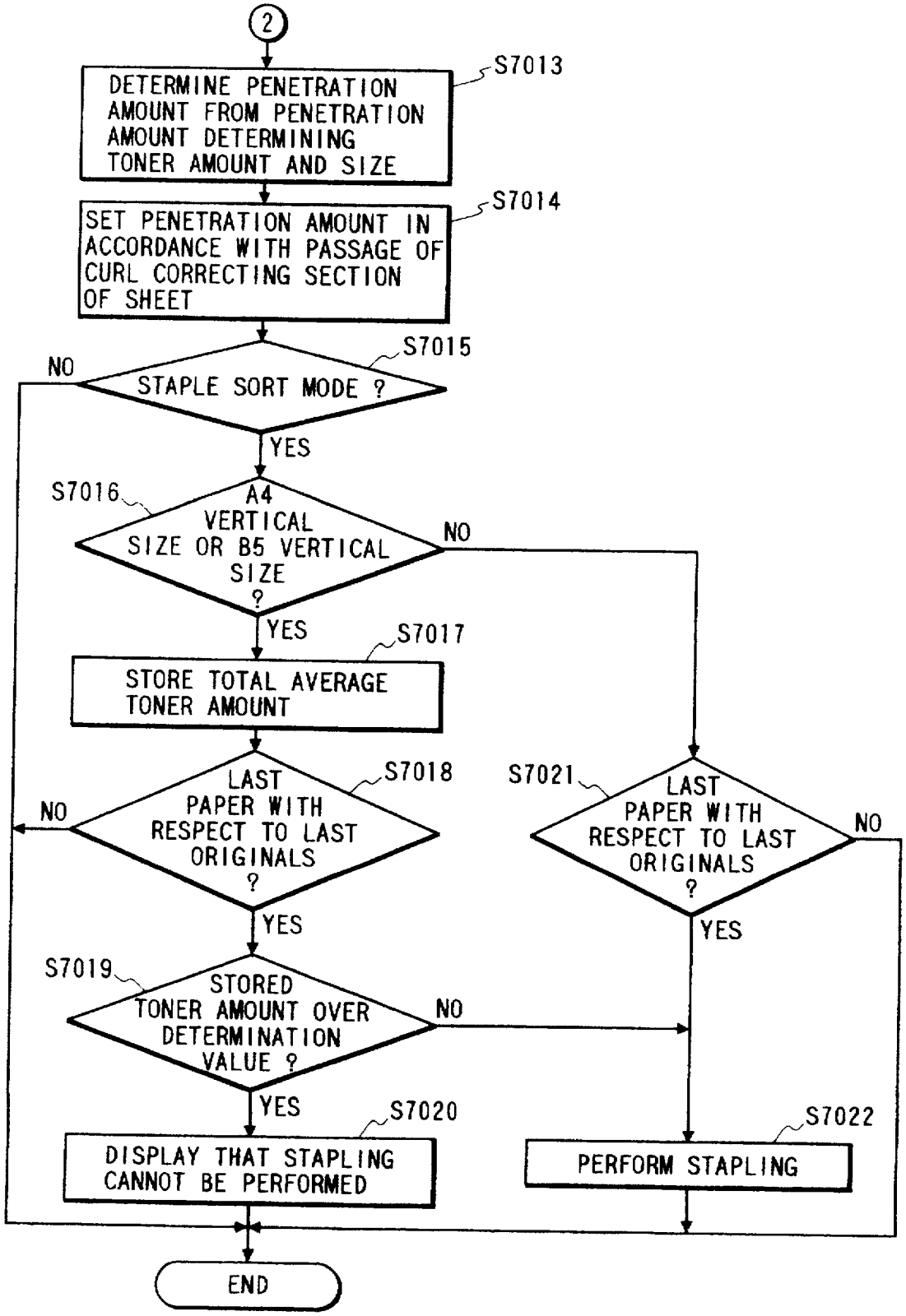
FIG. 19 is a flowchart for explaining another example of the curl correcting section and the paper ejection post-processing unit in FIG. 7.

After that, in case of the last original and the last paper, namely, in case of a timing when the stapling operation can be executed (S6012), a check is made to see if the total toner amount of even one paper in the stored total average toner amounts exceeds a predetermined value (S6013). If YES, since a quality of the staple cannot be guaranteed, a message such that the stapling operation is not executed is displayed on the display panel 369 as shown in FIG. 15 for the user (S6014). The operation is finished without executing the staple. This is because the paper of the A4 vertical size or the B5 vertical size is curled in the direction (width direction) perpendicular to the conveying direction from a viewpoint of the relation of the spaces and, on the other hand, the curl correcting section 500 can correct only the curl in the conveying direction. Namely, the curl correction cannot be sufficiently performed to the papers of those sizes. Even if the registration rod 606 intends to hit the side edge of such a paper, as shown in FIG. 16, the curled paper escapes and the proper registration cannot be guaranteed. Thus, the staple in a state in which the paper has correctly been registered cannot be guaranteed. On the other hand, even if the paper could be correctly registered, as shown in FIG. 16, since the edge portion of the sheet is floating, the normal staple cannot be guaranteed.

In the embodiment, in order to judge the inhibition of the staple of the paper of the A4 vertical size or B5 vertical size, whether the total average toner amount of even one paper exceeds the predetermined value or not has been judged. However, a similar effect can be also obtained even by using a method of judging by discriminating whether the number of papers in each of which the toner amount exceeds the predetermined value among the bundle of papers to be stapled exceeds a predetermined number of papers or not or a method of judging by a ratio at which the number of papers in each of which the toner amount exceeds the predetermined value.

In the embodiment, the operator sets the paper kind such as thick paper, sheet for OHP, or the like by the operation unit 704. However, it is also possible to automatically detect an OHP sheet by OHP sensors 51 and 52 or to automatically detect a thick paper by detecting a displacement amount of the resistration roller 50 when the sheet passes through the roller 50.

In the foregoing embodiment, in step S6013, even in any one of the paper of the A4 vertical size and the paper of the B5 vertical size, each toner amount has been compared with the predetermined value. However, it is also possible to construct in a manner such that the toner amount of the paper of the A4 vertical size is compared with a first predetermined value and the toner amount of the paper of the B5 vertical size is compared with a second predetermined value, thereby predicting a curl amount in accordance with the characteristics of each size and controlling whether the execution of the stapling operation is permitted or inhibited.

In the foregoing embodiment, the penetration amount X has been determined on the basis of the Table 1 in any mode. However, it is also possible to prepare tables (data 1 and data 2 per paper size) corresponding to the characteristics in the non-sort mode, staple sort mode, sort mode, and group mode and to decide the penetration amount X on the basis of those tables.

(Curl correction control at the time of formation of both-side images)

A curl correction control including the both-side image forming operation will now be described with reference to flowcharts of FIGS. 17A to 19. Explanation about the processing steps similar to those in the flowchart of FIGS. 13A and 13B mentioned above is omitted.

In the embodiment, as shown in FIG. 8, only the curl in the direction in which has an upward convex shape for the output paper such that the occurrence of a positive curl (convex downward) is predicted can be corrected. At the time of a both-side output in which images are formed on both sides and are outputted, when the toner amount of the both-side first side is large and the toner amount of the both-side second side is small, namely, when the image of the both-side second side is fixed by the fixing unit 9, if a large amount of toner is deposited on the lower side (image of the both-side first side) of the paper and a small amount of toner is deposited on the upper side (image of the both-side second side) of the paper, the paper in an opposite curl (convex upward) is sent to the curl correcting section 500. The opposite curl exerts an adverse influence on the stacking of the papers to the sorter 600.

Therefore, when such an opposite curl occurs and exerts an adverse influence on the stacking of the papers and, for example, in case of the sort mode, the image forming operation is stopped and the papers in the sorter 600 are removed. After that, the operation is restarted.

FIGS. 17A to 19 are the flowcharts for the curl correction control also including a countermeasure for a case of occurrence of the opposite curl due to the formation of the both-side images and include the flowchart of FIGS. 13A and 13B mentioned above. Therefore, in a manner similar to the case of FIGS. 13A and 13B, the control is started at a time point of the end of the formation of the image of the last color (S7000).

First, three toner amounts of the first half average toner amount TNRtop, latter half average toner amount TNRbottom, and total average toner amount TNRtotal described in FIGS. 13A and 13B mentioned above are calculated (S7001).

A check is subsequently made to see if the side is the automatic both-side first side (S7002). The "automatic both-side" denotes a case of forming both-side images by using the intermediate tray 22 (see FIG. 1). In the image forming apparatus of the embodiment, in addition to the method of using the intermediate tray 22, the both-side images can be also formed by setting a paper after the image was formed on one side into the recording material tray *7m* (hereinafter, such an operation is referred to as a "manual both-side").

A check is make whether the apparatus is in the non-sort mode (S7005). In step S7002, in case of the automatic both-side first side, the paper in which the image of the both-side first side has been formed is stored into the intermediate tray 22 without passing through the curl correcting section 500, so that the curl correction control is not executed. However, after such a paper had been fed from the intermediate tray 22 and the image of the both-side second side was formed, the curl correction control is executed. For such a control, therefore, the total average toner amount TNRtotal of the image of the automatic both-side first side is stored (S7003).

Subsequently, the calculated toner amounts are selectively used in accordance with the stacking mode for the sorter 600. In the non-sort mode, the total average toner amount TNRtotal is used as a toner amount to decide the penetration amount X (S7007).

In the sort mode, a check is made whether the apparatus is in the staple sort mode (S7006). In the staple sort mode for stapling in the sort mode and at the time of the end of the job, since the latter half portion of the paper is stapled, the latter half average toner amount TNRbottom is used as a toner amount to decide the penetration amount X (S7008).

In case of neither the non-sort mode nor the staple sort mode, namely, in case of the sort mode or the group mode for ejecting the papers to the sort bin 602, a larger one of the values of the first half average toner amount TNRtop and the latter half average toner amount TNRbottom is used as a toner amount to decide the penetration amount X in order to improve the stacking quality (S7009).

As for the toner amounts used to decide the penetration amount X in steps S7007, S7008, and S7009, since there is a possibility such that the correction calculation using the toner amount of the both-side first side is executed at the time of an automatic both-side second side, which will be explained hereinlater, such a toner amount is temporarily set to a provisional toner amount for determining the penetration amount X.

In step S7010, a check is made to see if the side is the automatic both-side second side. A case where the mode is not the automatic both-side second side will be first explained.

When the mode is not the automatic both-side second side, namely, in case of the one-side output or the manual both-side using the recording material tray *7m*, a correction of the automatic both-side second side, which will be explained hereinlater, is unnecessary for the provisional toner amount for deciding the penetration amount X which has been determined in each of steps S7007, S7008, and S7009. Therefore, such a toner amount is used as a proper toner amount for deciding the penetration amount X (S7012). The same control as that in steps S6007 to S6016 in the flowchart of FIGS. 13A and 13B mentioned above is executed in steps S7013 to S7022 in FIG. 19. In case of the image forming operation of the both-side second side of the manual both-side using the recording material tray *7m*, since there is no method of storing the toner amount of the both-side first side although it is a both-side image, the same control as that for one side, namely, the curl correction control is executed by the toner amount calculation by only the both-side second side image is executed.

In case of the automatic both-side second side in step S7010, the toner amount of the both-side first side stored in step S7003 is subtracted from the provisional toner amount decided in step S7007, S7008, or S7009 in accordance with the operating mode of the sorter 600 at the time of the both-side second side and the resultant value is used as a toner amount to decide the penetration amount X (S7011).

This is because it has experimentally confirmed that the curl growth amount when images are formed on both sides is proportional to the difference between the toner amounts of the both-side first side and the both-side second side. When a specific example which can be easily understood is mentioned, it has been confirmed that so long as the toner amounts of the both-side first side and the both-side second side are equal, the curl hardly grows. When the toner amount of the both-side first side is large and the toner amount of the both-side second side is small, the paper is ejected to the sorter 600 in an opposite curl (convex upward) state as mentioned above. When such an opposite curl (convex upward) at the time of the both-side output exerts an adverse influence on the stacking performance of the sorter 600 and the registration operation, the processing contents are changed in accordance with the operating mode of the sorter 600 and the image forming operation is continued. Or, after the papers in the sort bin 602 were once removed, the image forming operation is restarted.

Figure 21:
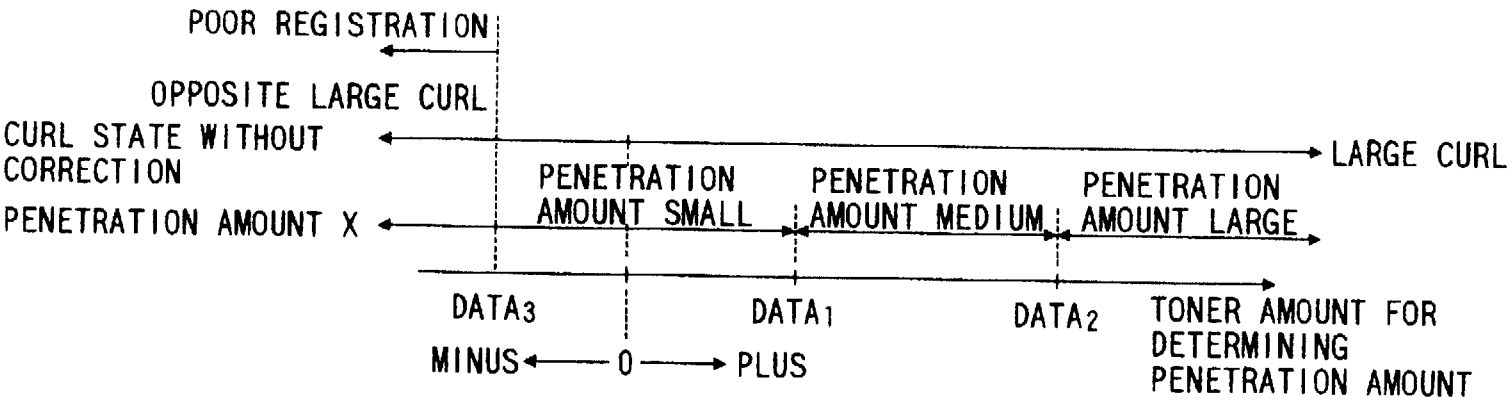
FIG. 21 is an explanatory diagram of the relation between a toner amount to decide a penetration amount which is obtained in the step in FIGS. 17A and 17B and a curl.

Namely, first in step S7023, a check is made to see if a poor registration due to the opposite curl (convex upward) has occurred. FIG. 21 shows the relation between the poor registration due to the opposite curl and the toner amount to decide the penetration amount X at the automatic both-side second side. FIG. 21 shows a state in which minus data has been added to FIG. 14 mentioned above. The toner amount which is determined in step S7011 can have both of the plus data and the minus data in accordance with the toner amount of the both-side first side. When the toner amount that is decided in step S7011 is minus data and is smaller than data 3 shown in FIG. 21, the opposite curl amount is large and the curl correction control also doesn't effectively function as mentioned above. In such a case, therefore, it is judged that there is a possibility such that the poor registration occurs in step S7023. On the contrary, when the toner amount is larger than the data 3, even when the paper is in the opposite curl state, the registration operation or stapling operation can normally be performed. Therefore, the same control as that in steps S6007 to S6016 in the flowchart of FIGS. 13A and 13B mentioned above is executed in steps S7013 to S7022 in FIG. 19.

Even when the toner amount is smaller than the data 3, in case of the non-sort mode for outputting the papers to the non-sort bin, since the registration operation by the registration rod is not performed, the image forming operation is executed as it is from step S7024 (steps S7013 to S7022).

Subsequently, a check is made to see if the operating mode of the sorter 600 is the group mode (S7025). If YES, the paper of the same image (toner amount) is stacked to the same sort bin 602 and the occurrence of a poor registration due to the opposite curl is also similarly predicted for the paper which will be stacked from now on. Therefore, the image formation is guaranteed for the paper which has already been fed. A message as shown in FIG. 20B is displayed on the display panel 369 (S7030). With respect to the paper which is not yet fed, the image formation is inhibited and the operation is finished (S7031).

When the operating mode of the sorter 600 is not the group mode in step S7025, namely, in case of the sort mode or the staple sort mode, the output papers such that the poor registration by the opposite curl is predicted are stacked one by one to the sort bin 602. Therefore, the image forming operation is continued until the output papers are stacked to each sort bin 602 (S7026). After that, a message as shown in FIG. 20A is displayed on the display panel 369 (S7027), thereby notifying the user so as to remove the papers from the sort bin 602.

After the message was displayed, the apparatus waits until a sensor (not shown) in the sort bin of the sorter 600 detects that the papers were removed from the sort bin 602 (S7028). The image forming operation is again restarted (S7029). In this instance, since the papers such that the poor registration due to the opposite curl is predicted don't exist in the sort bin 602, the normal stacking operation can be performed.

In the embodiment, although the data 3 in FIG. 21 has been used to judge the defective stacking by the opposite curl in step S7023, by changing the data 3 in accordance with the paper size or paper kind, the judgment can be more accurately performed.

[Second embodiment]

By using the construction such that the calculation region of the toner amount is further increased to two regions of the first half and latter half in the paper conveying direction or more in accordance with the kind of staple such as corner binding, double binding, single binding, or the like shown in the first embodiment or the toner amounts of the portion in not only the paper feeding direction but also the direction perpendicular to the paper feeding direction can be calculated, the control of the more accurate curl correction according to the kind of staple can be controlled.

[Third embodiment]

In the first embodiment, although the method of calculating the toner amount from the surface electric potential amount of the potential sensor 12 has been shown, as a method of calculating the toner amount, the image signal after the sensor 13 for detecting the light amount on the drum or the printer gradation correcting circuit 109 in FIGS. 3A and 3B is added and the resultant signal can be also converted into the toner amount.

[Fourth embodiment]

According to the first embodiment, as shown in step S6010 in FIGS. 13A and 13B, the control in which the growing direction of the curl is predicted in accordance with the direction of the paper has been performed. However, since there is a case where the relation between the spaces or the like as a factor in the growing direction of the curl and the direction of the paper differs depending on a paper manufacturing company or articles, information of the relations among the paper manufacturing company, the trade names, and the curl growing direction is previously stored in the ROM 750 or RAM 751, the printer controller 701 discriminates whether the width direction of the ejected paper is a direction such that the curl can easily grows or not on the basis of the stored information with reference to the ROM 750 or RAM 751 in place of step S6010 in FIGS. 13A and 13B. When the width direction is the direction such that the curl can easily grow, the processing routine advances to step S6011. When it is not the direction such that the curl can easily grow, the processing routine advances to step S6015. It is sufficient that the manufacturing company and trade name of the papers to be used are selectively set from the operation unit 704 by the operator.

What is claimed is:

1. An image forming apparatus comprising:

image forming means for forming an image on a sheet;

detecting means for detecting a processing amount of said image forming means which becomes a factor of an occurrence of the curl of said sheet;

a tray for receiving the sheet;

registration means for registering a direction perpendicular to the sheet conveying direction of the sheet on said tray;

binding means for binding the sheet on said tray; and inhibiting means for inhibiting a binding operation of said binding means in accordance with the detection result of said detecting means.

2. An image forming apparatus comprising:

image forming means for forming an image onto a sheet;

curl correcting means which can correct a curl of said sheet in which a correction amount can be adjusted;

detecting means for detecting a processing amount of said image forming means which becomes a factor of an occurrence of the curl of said sheet; and control means for controlling the correction amount of the curl by said curl correction means on the basis of a detection result of said detecting means, wherein said curl correcting means corrects the curl in a sheet conveying direction, and said image forming apparatus further has: a tray for receiving the sheet whose curl has been corrected by said curl correction means; registration means for registering a direction perpendicular to the sheet conveying direction of the sheet on said tray; binding means for binding the sheet on said tray; and inhibiting means for inhibiting a binding operation of said binding means in accordance with the detection result of said detecting means.

3. An apparatus according to claim 2, wherein said detecting means detects said processing amount every predetermined region of said sheet.

4. An apparatus according to claim 2, wherein as said processing amount, said detecting means detects an amount of toner which is fixed to said sheet by said image forming means.

5. An apparatus according to claim 2, wherein said control means controls the correction amount of the curl by said curl correcting means in accordance with a kind of said sheet.

6. An apparatus according to claim 2, wherein said curl correcting means passes said sheet between a soft roller and a hard roller and can adjust the correction amount of the curl of said sheet in accordance with a contact pressure between said rollers.

7. An apparatus according to claim 2, wherein when characteristics of the curl of said sheet are characteristics such that the sheet can easily be curled in said perpendicular direction, said inhibiting means is activated, and when the characteristics of the curl of said sheet are characteristics such that the sheet can easily be curled in said sheet conveying direction, said inhibiting means is not activated.

8. An apparatus according to claim 7, wherein when the sheet of an A4 size or a B5 size is conveyed in a longitudinal direction of the sheet, said inhibiting means is activated, and when the sheet is conveyed in a minor direction of said sheet, said inhibiting means is not activated.

9. An apparatus according to claim 7, further having:

memory means for storing information indicative of a relation between a trade name of the sheet and curl characteristics;

selecting means for selecting the trade name of the sheet; and control means for controlling whether said inhibiting means is activated or not on the basis of a selection result of said selecting means and said relation information stored in said memory means.

10. An apparatus according to claim 2, wherein said image forming means can form images on both sides of said sheet, said detecting means detects said processing amount of each of a front side and a back side of the sheet, and said image forming apparatus further has control means for stopping an operation of said image forming means in accordance with the processing amounts of the front side and back side of the sheet which were detected by said detecting means.

11. An apparatus according to claim 10, wherein said image forming means first forms an image on the front side of the sheet and, after that, forms an image on the back side of the sheet, and said control means stops the operation of said image forming means when the processing amount of the front side is larger than the processing amount of the back side of the sheet.

12. An apparatus according to claim 10, further having stapling means for stapling the sheet on which the image has been formed and which was ejected onto the tray, wherein an operation of said stapling means is inhibited when said processing amount which is detected by said detecting means exceeds a predetermined amount.

* * * * *

UNITED STATES PATENT AND TRADEMARK OFFICE

CERTIFICATE OF CORRECTION

PATENT NO. : 5,749,040

DATED : May 5, 1998

INVENTOR(S) : Masanori MURAMATSU

It is certified that error appears in the above-identified patent and that said Letters Patent is hereby corrected as shown below:

COLUMN 1:

Line 34, "occurs" should read --and occurs--.

COLUMN 2:

Line 13, "comprised of" should read --comprises--.
Line 16, "comprised of" should read --comprises--.
Line 46, "comprised of" should read --comprises--.
Line 57, "comprised of" should read --comprises--.

COLUMN 3:

Line 33, "rotatably" should read --rotatable--.

COLUMN 5:

Line 64, "come" should read --brought--.
Line 67, "come" should read --brought--.

UNITED STATES PATENT AND TRADEMARK OFFICE

CERTIFICATE OF CORRECTION

PATENT NO. : 5,749,040

DATED : May 5, 1998

INVENTOR(S) : Masanori MURAMATSU

It is certified that error appears in the above-identified patent and that said Letters Patent is hereby corrected as shown below:

COLUMN 7:

Line 54, "total" should read --a total of--.

COLUMN 8:

Line 52, "denote" should read --denotes--.

COLUMN 9:

Line 36, "*Bk=A●min*" should read --*Bk=A·min*--.
Line 49, "*D1●Bk) C1=B2●(C2-D2●Bk) Y1=B3●(Y2-*" should read --*D1·Bk) C1=B2·(C2-D2·Bk) Y1=B3·(Y2-* --.
Line 50, "*D3●Bk*" should read --*D3·Bk*--.

COLUMN 10:

Line 6, "all" should read --all--.
Line 9, "all" should read --all--.

UNITED STATES PATENT AND TRADEMARK OFFICE

CERTIFICATE OF CORRECTION

PATENT NO. : 5,749,040

DATED : May 5, 1998

INVENTOR(S) : Masanori MURAMATSU

It is certified that error appears in the above-identified patent and that said Letters Patent is hereby corrected as shown below:

COLUMN 13:

Line 27, "a uniform density" should read --the toner density is uniform--.

COLUMN 14:

Line 18, "every" should read --for every--.

COLUMN 15:

Line 61, "has" should read --there is--.

COLUMN 16:

Line 9, "and" should read --it--.

UNITED STATES PATENT AND TRADEMARK OFFICE

CERTIFICATE OF CORRECTION

PATENT NO. : 5,749,040

DATED : May 5, 1998

INVENTOR(S) : Masanori MURAMATSU

It is certified that error appears in the above-identified patent and that said Letters Patent is hereby corrected as shown below:

COLUMN 17:

Line 29, "is executed" should be deleted.
Line 37, "has" should read --has been--.
Line 54, "were once" should read --are first--.
Line 61, "minus" should read --negative--.
Line 63, "plus" should read --positive--.
Line 64, "minus" should read --negative--.
Line 66, "minus" should read --negative--.

Signed and Sealed this

Twenty-ninth Day of December, 1998

*Attest:*

*Attesting Officer*

BRUCE LEHMAN

*Commissioner of Patents and Trademarks*